US009627779B2

(12) United States Patent
Legay et al.

(10) Patent No.: US 9,627,779 B2
(45) Date of Patent: Apr. 18, 2017

(54) TWO-DIMENSIONAL MULTI-BEAM FORMER, ANTENNA COMPRISING SUCH A MULTI-BEAM FORMER AND SATELLITE TELECOMMUNICATION SYSTEM COMPRISING SUCH AN ANTENNA

(71) Applicants: THALES, Neuilly-sur-Seine (FR); UNIVERSITE DE RENNES 1, Rennes (FR); CENTRE NATIONAL DE LA RECHERCHE SCIENTIFIQUE, Paris (FR)

(72) Inventors: Hervé Legay, Plaisance du Touch (FR); Ronan Sauleau, Acigne (FR); Mauro Ettorre, Rennes (FR)

(73) Assignees: THALES, Courbevoie (FR); UNIVERSITE DE RENNES 1, Rennes (FR); CENTRE NATIONAL DE LA RECHERCHE SCIENTIFIQUE, Paris (FR)

( * ) Notice: Subject to any disclaimer, the term of this patent is extended or adjusted under 35 U.S.C. 154(b) by 258 days.

(21) Appl. No.: 14/374,855

(22) PCT Filed: Jan. 25, 2013

(86) PCT No.: PCT/EP2013/051509
§ 371 (c)(1),
(2) Date: Jul. 25, 2014

(87) PCT Pub. No.: WO2013/110793
PCT Pub. Date: Aug. 1, 2013

(65) Prior Publication Data

US 2014/0354499 A1 Dec. 4, 2014

(30) Foreign Application Priority Data

Jan. 27, 2012 (FR) ..... 12 00244

(51) Int. Cl.
*H01Q 25/00* (2006.01)
*H01Q 3/26* (2006.01)
(Continued)

(52) U.S. Cl.
CPC ..... *H01Q 25/00* (2013.01); *H01Q 3/26* (2013.01); *H01Q 3/2664* (2013.01);
(Continued)

(58) Field of Classification Search
CPC ..... H01Q 3/26; H01Q 3/2664; H01Q 19/138; H01Q 21/0025; H01Q 21/0031; H01Q 25/001
(Continued)

(56) References Cited

U.S. PATENT DOCUMENTS 3,170,158 A 2/1965 Rotman
3,979,754 A * 9/1976 Archer ..... H01Q 3/34 342/374
(Continued)

FOREIGN PATENT DOCUMENTS

FR 2944153 A1 10/2008
WO 2005099042 A1 10/2005
WO 2008087388 A1 7/2008

OTHER PUBLICATIONS

International Search Report Dated May 21, 2014 for International Patent Application No. PCT/EP2013/051509.

*Primary Examiner* — Graham Smith
*Assistant Examiner* — Daniel J Munoz
(74) *Attorney, Agent, or Firm* — Baker & Hostetler LLP

(57) ABSTRACT

The multi-beam former comprises: two stages connected together and intended to synthesize beams focused along two directions in space; each stage comprises at least two multi-layer plane structures (P11, P1Ny), (P21, P2Mx), superposed one above the other; each multi-layer structure
(Continued)

Figure 1A:
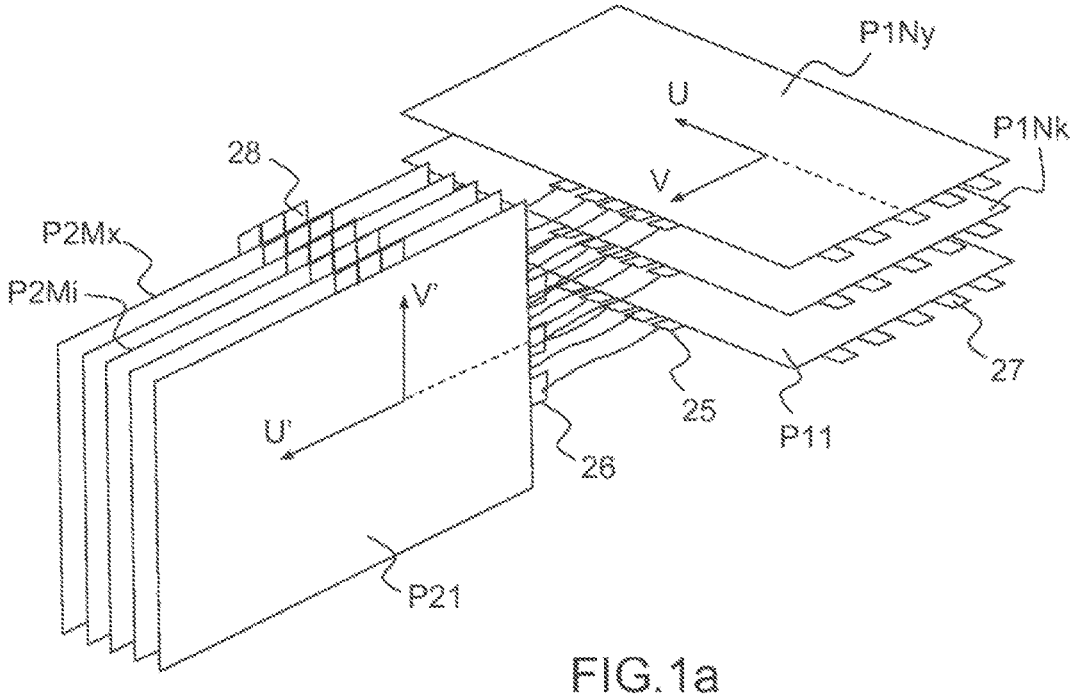

(P11, P1Ny, P21, P2Mx) comprises an internal reflector, at least two first internal sources disposed in front of the internal reflector and linked to two input/output ports (27, 26) aligned along an axis (V, V'), at least two second internal sources disposed in a focal plane of the internal reflector and linked to two second input/output ports (25, 28) aligned along an axis (U, U') perpendicular to the axis (V, V'); the two second internal sources of the same multi-layer structure (P11) of the first stage are respectively linked to two first internal sources of two different multi-layer structures (P21), (P2Mx) of the second stage.

17 Claims, 15 Drawing Sheets

(51) Int. Cl.

| | |
|---|---|
| ***H01Q 19/13*** | (2006.01) |
| ***H01Q 21/00*** | (2006.01) |
| ***H01Q 13/02*** | (2006.01) |
| ***H01Q 19/18*** | (2006.01) |

(52) U.S. Cl.
CPC ..... *H01Q 13/02* (2013.01); *H01Q 19/138* (2013.01); *H01Q 19/18* (2013.01); *H01Q 21/00* (2013.01); *H01Q 21/0031* (2013.01)

(58) Field of Classification Search
USPC ..... 343/754, 911 R
See application file for complete search history.

(56) References Cited

U.S. PATENT DOCUMENTS

| | | | | |
|---|---|---|---|---|
| 4,051,476 | A * | 9/1977 | Archer | H01Q 1/38 343/700 MS |
| 5,162,803 | A | 11/1992 | Chen | |
| 6,081,239 | A * | 6/2000 | Sabet | H01Q 1/40 343/700 MS |
| 2005/0264452 | A1* | 12/2005 | Fujishima | H01Q 1/243 343/700 MS |
| 2007/0212008 | A1 | 9/2007 | Schoebel | |
| 2012/0092224 | A1 | 4/2012 | Sauleau et al. | |

* cited by examiner

TWO-DIMENSIONAL MULTI-BEAM FORMER, ANTENNA COMPRISING SUCH A MULTI-BEAM FORMER AND SATELLITE TELECOMMUNICATION SYSTEM COMPRISING SUCH AN ANTENNA

CROSS-REFERENCE TO RELATED APPLICATIONS

This application is a National Stage of International patent application PCT/EP2013/051509, filed on Jan. 25, 2013, which claims priority to foreign French patent application No. FR 1200244, filed on Jan. 27, 2012, the disclosures of which are incorporated by reference in their entirety.

FIELD OF THE INVENTION

The present invention relates to a two-dimensional multi-beam former, an antenna comprising such a multi-beam former and a satellite telecommunication system comprising such an antenna. It applies notably to the field of satellite telecommunications.

BACKGROUND

In the field of satellite telecommunications, it is necessary to employ a beamforming antenna making it possible to cover a vast territory, such as Europe for example, with a very large number of fine beams having an angular aperture of for example less than 0.2°, and with good overlap of the beams.

A first architecture of beamforming antenna, called a reflector antenna with a focal array, consists in using an array of sources associated with a reflector, for example parabolic, the array of sources, called a focal array, being placed in a focal plane situated at the focus of the reflector. In reception, the reflector reflects an incident plane wave received and focuses it in the focal plane of the reflector on the focal array. Depending on the direction of arrival of the incident plane wave on the reflector, its focusing by the reflector is carried out at various points of the focal plane. The reflector therefore makes it possible to concentrate the energy of the incident signals received on a reduced zone of the focal array, this zone depending on the direction of arrival of the incident signal. The synthesis of a beam corresponding to a particular direction can therefore be carried out on the basis of a reduced number of preselected sources of the focal array, typically of the order of seven sources for a focal array comprising for example of the order of two hundred sources. The sources selected for the synthesis of a beam are different from one beam to another and selected according to the direction of arrival of the incident signals on the reflector. For the synthesis of a beam, a beamformer combines all the signals focused on the sources selected dedicated to this beam. The number of sources dedicated to a beam being small, this type of antenna exhibits the advantage of operating with a beamformer of reduced complexity which poses no major problem in respect of its production even when the number of beams increases appreciably, for example for 400 beams. However in case of loss of a source, for example subsequent to a fault with a signal amplifier positioned at the output of this source, the corresponding beam will be greatly impaired. To avoid the loss of a source, it is therefore necessary to double the number of amplifiers positioned at the output of each source as well as all the corresponding electronic control pathways. This increases the complexity and bulk of the antenna.

A second architecture of beamforming antenna, called a phased array antenna, consists in using an array of direct-radiation radiating sources in which all the sources participate in the synthesis of each of the beams, the synthesis of each beam being carried out by a beamformer by applying a phase shift matrix at the output of the array of radiating sources so as to compensate for the radiation delay of the sources with respect to one another for each direction of radiation of the array of radiating sources. Consequently, all the beams are formed by the whole set of sources, only the delay law applied to each source changes from beam to beam. This architecture exhibits the advantage of lesser sensitivity of the antenna in case of loss of sources and makes it possible to decrease the number of amplification pathways by a factor of two but exhibits the drawback of a beamformer which is very complex to produce, or indeed impossible to produce currently when the number of beams to be synthesized is very significant. Indeed, to synthesize for example a beam with an array of 300 radiating sources, the beamformer must combine the 300 RF signals at the output of each source. To synthesize 100 beams with an array of 300 radiating sources, this combining must be carried out 100 times. The corresponding phase shift matrices are therefore very voluminous and cannot be produced with RF circuits. Consequently, this type of antenna currently exists only for a limited number of beams and sources, such as for example 6 beams and 64 sources.

It is possible to carry out the synthesis of a large number of beams and to obtain a large number of spots by using digital beamforming. Accordingly, the RF signals are converted at the level of each source into digital signals before being applied as input to the digital beamformer. However, this solution requires the implanting of frequency transposition devices and analog-digital converters at the level of each source, thereby increasing the complexity, mass, volume and consumption of the antenna and is not acceptable for use in the field of multimedia telecommunications.

A third architecture of multiple-beam forming antenna, consists in using a phased array which comprises sources of small size and is magnified by an optical system comprising one or more reflectors. This architecture can be called an imaging array antenna, since globally the focal array retains the same characteristics as a direct-radiation phased array, the synthesis of a spot being carried out by almost the entirety of the sources.

A first configuration of imaging array antenna comprises two parabolic reflectors, main and secondary, having the same focus and a phased array. The main parabolic reflector is of large size, the secondary parabolic reflector is of smaller size, the phased array placed in front of the secondary reflector comprises sources of reduced size. The behavior of this antenna is similar to that of the direct-radiation phased array antenna but exhibits the advantage of increasing the size of the radiating aperture of the antenna with respect to a direct-radiation phased array antenna, with a magnification factor defined by the ratio of the diameters of the two reflectors, thereby making it possible to decrease the size of the sources of the phased array and therefore the size of the beams. Its main drawback resides in the complexity of the beamformer associated with the phased array since, as in the case of the direct-radiation phased array antenna, the whole set of sources participates in the contribution of the whole set of beams.

A second configuration of imaging array antenna comprises a single parabolic reflector and a defocused phased array placed in front of the reflector. This configuration exhibits a magnification factor of the radiating aperture of the antenna with respect to a direct-radiation phased array antenna, equal to the ratio between the focal length of the parabolic reflector and the distance at which the array has been defocused. In this configuration, most of the sources participate in an identical manner in the contribution of the whole set of beams, but the operation of the phased array is a little different from that of a direct-radiation phased array, or from that of the phased array associated with the first imaging array antenna configuration. Unlike these two types of phased arrays which emit a plane wave, the defocused array associated with an imaging array antenna configuration with a single reflector emits a spherical wave, which is converted into a plane wave by the main reflector.

The two imaging array antenna configurations exhibit two major drawbacks. Because of the remoteness of the phased array from the focus of the reflector or reflectors, they induce aberrations. Indeed, the phase distribution over the radiating aperture associated with the main reflector is affected by a spatial phase distortion which is all the more significant as the signal beam is squinted. These phase distortions are manifested by a degradation of the radiated beam and must be compensated for by modifying the feed law for the phased array. The two imaging array antenna configurations also exhibit a second drawback stemming from the variation of the size of the radiating aperture as a function of the squinting of the beam and due to the fact that the surface area of interception of a beam emitted by the phased array varies as a function of the squint angle. To obtain a radiating aperture of identical size, it is then necessary to adjust the size of the phased array as a function of the squint angle.

On account of these various drawbacks, an orthogonal-beam former, developed for a direct-radiation phased array, is not optimal if it is used for imaging array antennas. The beamformer must be designed in association with the optical system of the antenna, that is to say with the reflector or reflectors, this being impossible with existing beamformers for which the beamformer is designed independently of the antenna reflectors.

A fourth architecture of beamforming antenna comprises a quasi-optical beamformer in which a signal emitted by a set of input ports is guided between two parallel metallic plates toward an output port. The propagation of the signal emitted is interrupted by a reflector wall which reflects it and focuses it on the output port.

Two different configurations of quasi-optical beamformer exist. According to a first configuration, the input and output ports are situated in one and the same propagation medium defined between two parallel plates, the propagation medium being able to comprise a dielectric. In this case, the input and output ports are distributed along two distinct orthogonal axes and the reflector wall is illuminated with an angle of offset so that it transmits the entirety of the signal from the input ports to one, or several, output port or output ports.

According to a second configuration, called a pill-box structure, the input and output ports are situated in two different superposed propagation media, each propagation medium being defined between two parallel metallic plates. The two substrate layers constituting the two propagation media are coupled by an internal reflector wall extending transversely with respect to the planes of the layers. The first substrate layer, for example the lower layer, comprises at least one RF energy source placed at the focus of the internal reflector. The output ports are situated in the second substrate layer. To improve the transition of the waves between the two substrate layers, document FR 2 944 153 describes the making of coupling slots extending along the internal reflector.

In these two configurations, in emission, the energy source placed at the focus of the internal reflector emits a cylindrical incident wave guided in the tri-plate propagation medium. The cylindrical incident wave is reflected by the internal reflector which transforms it into a plane wave. The reflected plane wave is thereafter conveyed by waveguides up to an array of radiating slots. The energy is then radiated by radiating slots in the form of a beam. The formation of the beam radiated by the antenna is carried out in a natural manner by simple guidance of the wave in the substrate layer, or in the two substrate layers, and by way of the quasi-optical transition means consisting of the internal reflector and optionally the coupling slots. The displacement of the source in the plane of the focus of the reflector generates wavefronts corresponding to given directions of propagation. A scan and a squinting of the beam in elevation, in a plane perpendicular to the plane of the antenna, is obtained by switching various sources. However, given that the sources are situated in one and the same plane, the squinting of the beam cannot be carried out in all directions in space but only in a single plane and no azimuthal beamforming is possible.

SUMMARY OF THE INVENTION

A first aim of the invention is to produce a multi-beam former which does not comprise the drawbacks of existing beamformers, is simple to implement, allows the formation of a large number of fine beams with good overlap of the beams in a wide angular domain and makes it possible to ensure squinting of the beams in all directions in space.

A second aim of the invention is to produce a beamformer that can be designed and dimensioned in association with reflectors of an antenna.

A third aim of the invention is to produce a multiple-beam forming antenna and in particular an imaging array antenna comprising such a multi-beam former and in which, the phase aberrations are greatly reduced.

Accordingly, the invention relates to a two-dimensional multi-beam former comprising a first beamforming stage intended to synthesize beams focused along a first direction X in space and a second beamforming stage intended to focus the beams formed by the first stage along a second direction Y in space, the two stages being connected together. Each stage comprises at least two multi-layer plane structures superposed one above the other. Each multi-layer structure of the first and of the second stage comprises an internal reflector extending transversely to the plane of the multi-layer structure, at least two first internal sources disposed in front of the internal reflector and respectively linked to two first input/output ports aligned along a first axis of the multi-layer structure, at least two second internal sources disposed in a focal plane of the internal reflector and respectively linked to two second input/output ports aligned along a second axis of the multi-layer structure perpendicular to the first axis. The two second internal sources of the same multi-layer structure of the first beamforming stage are respectively linked to two first internal sources of two different multi-layer structures of the second beamforming stage by way of the input/output ports, called linking ports, to which are respectively connected the second internal sources and the first internal sources.

Advantageously, the first beamforming stage comprises Ny plane multi-layer structures superposed one above the other, each multi-layer structure of the first stage comprising Nx first internal sources disposed in front of the internal reflector of the corresponding multi-layer structure and connected to Nx input/output ports aligned parallel to an axis V and Mx second sources disposed in the focal plane of the corresponding internal reflector and connected to Mx linking ports aligned parallel to an axis U perpendicular to the axis V. Furthermore, the second beamforming stage comprises Mx plane multi-layer structures superposed one above the other, each multi-layer structure of the second beamforming stage comprising Ny first internal sources disposed in front of the internal reflector of the corresponding multi-layer structure and connected to Ny linking ports aligned parallel to an axis V' and My second sources disposed in the focal plane of the corresponding internal reflector (16) and connected to My input/output ports aligned parallel to an axis U' perpendicular to the axis V'. The Ny multi-layer structures of the first stage comprise Ny*Mx linking ports connected respectively to Mx*Ny corresponding linking ports of the Mx multi-layer structures of the second stage, Nx, Ny, Mx, My being integer numbers greater than 1, the linking ports of one and the same multi-layer structure of the first beamforming stage being respectively connected to different multi-layer structures of the second beamforming stage.

Advantageously, each linking port of the Nkth multi-layer structure of the first beamforming stage is connected to the Nkth linking port of one of the corresponding multi-layer structures of the second beamforming stage, Nk being an integer number lying between 1 and Ny inclusive.

According to a first embodiment of the multi-layer structures of the invention, each multi-layer structure comprises an upper metallic plane, a lower metallic plane and a single substrate layer inserted between the upper metallic plane and the lower metallic plane, the internal reflector extends transversely in the substrate layer from the lower metallic plane to the upper metallic plane and the first internal sources and second internal sources of each multi-layer structure are disposed in the substrate layer and linked respectively to a first and a second input/output port, the first and second input/output ports being disposed in two orthogonal directions of the plane of the substrate layer.

According to a second embodiment of the multi-layer structures of the invention, the first internal sources of each multi-layer structure are disposed in a first substrate layer inserted between an upper metallic plane and an intermediate metallic plane, the second sources are disposed in a second substrate layer inserted between the intermediate metallic plane and a lower metallic plane; the first and second substrate layers are coupled by the internal reflector extending from the lower metallic plane to the upper metallic plane and by way of an aperture or of coupling slots extending along the internal reflector and made in the intermediate metallic plane separating the two substrate layers; each multi-layer structure furthermore comprises first waveguides disposed in the second substrate layer, each first waveguide comprising a first guide part extending along a longitudinal axis of the multi-layer structure and connected to the second internal sources and a second bent guide part extending perpendicularly to the longitudinal axis and linked to a second input/output port.

According to one embodiment of the multi-beam former of the invention, the second beamforming stage comprises Mx first multi-layer structures and at least Mx second multi-layer structures and each linking port of the Nkth multi-layer structure of the first beamforming stage is connected to the Nkth linking port of one of the corresponding first multi-layer structures of the second beamforming stage and to the Nkth linking port of one of the second multi-layer structures of the second beamforming stage, Nk being an integer number lying between 1 and Ny inclusive.

According to another embodiment of the multi-beam former of the invention, the Mx second multi-layer structures of the second beamforming stage comprise first internal sources linearly shifted with respect to the first internal sources of the Mx first multi-layer structures of the second beamforming stage, the linear shift corresponding to a translation of all the first internal sources by one and the same distance T of less than a distance between centers of two first consecutive internal sources.

Alternatively, the Mx second multi-layer structures of the second beamforming stage comprise an internal reflector having an orientation shifted with respect to the internal reflector of the Mx first multi-layer structures of the second beamforming stage.

According to another embodiment of the multi-beam former of the invention, the first beamforming stage comprises Ny first and Ny second multi-layer structures and the first internal sources of the Ny second multi-layer structures are linked to the first internal sources of the Ny first multi-layer structures, the Ny second multi-layer structures of the first beamforming stage comprising first internal sources linearly shifted with respect to the first internal sources of the Ny first multi-layer structures of the first beamforming stage.

Alternatively, the first beamforming stage comprises Ny first and Ny second multi-layer structures and the first internal sources of the Ny second multi-layer structures are linked to the first internal sources of the Ny first multi-layer structures, the Ny second multi-layer structures of the first beamforming stage comprising an internal reflector having an orientation shifted with respect to the internal reflector of the Ny first multi-layer structures of the first beamforming stage.

Optionally, the single substrate layer or the first and second substrate layers of each multi-layer structure comprise a dielectric material.

Advantageously, the dielectric material is a dielectric lens placed between the internal reflector and the first internal sources and second internal sources, the dielectric lens having a convex periphery surface and comprising inclusions of air holes, the inclusions of air holes having a density increasing progressively from the internal reflector to the first internal sources and the second internal sources.

Optionally, the single substrate layer or the first and second substrate layers of each multi-layer structure furthermore comprise a first dielectric material having a first dielectric permittivity, the first dielectric material comprising inclusions of a second dielectric material having a second dielectric permittivity lower than the first dielectric permittivity, the inclusions having a density increasing from the internal reflector to the first internal sources and the second internal sources.

Advantageously, the first substrate layer and the second substrate layer of each multi-layer structure comprise deformation means for deforming the internal reflector.

The invention also relates to a multi-beam antenna, comprising at least one such two-dimensional multi-beam former and a phased array consisting of a plurality of elementary radiating elements, each elementary radiating element being linked to a corresponding input/output port of the first beamforming stage by way of a pathway for emitting and of a pathway for receiving RF signals.

According to one embodiment, the antenna furthermore comprises at least one main reflector, the phased array connected to the two-dimensional multi-beam former being placed in front of the main reflector in a defocused plane.

According to another embodiment, the antenna furthermore comprises at least one main reflector and an auxiliary reflector, the main reflector and the auxiliary reflector having different sizes and having the same focal length F and in that the phased array connected to the two-dimensional multi-beam former is placed in front of the auxiliary reflector.

Advantageously, each pathway for emitting and for receiving RF signals comprises a dynamic phase shifter.

Figure 1B:
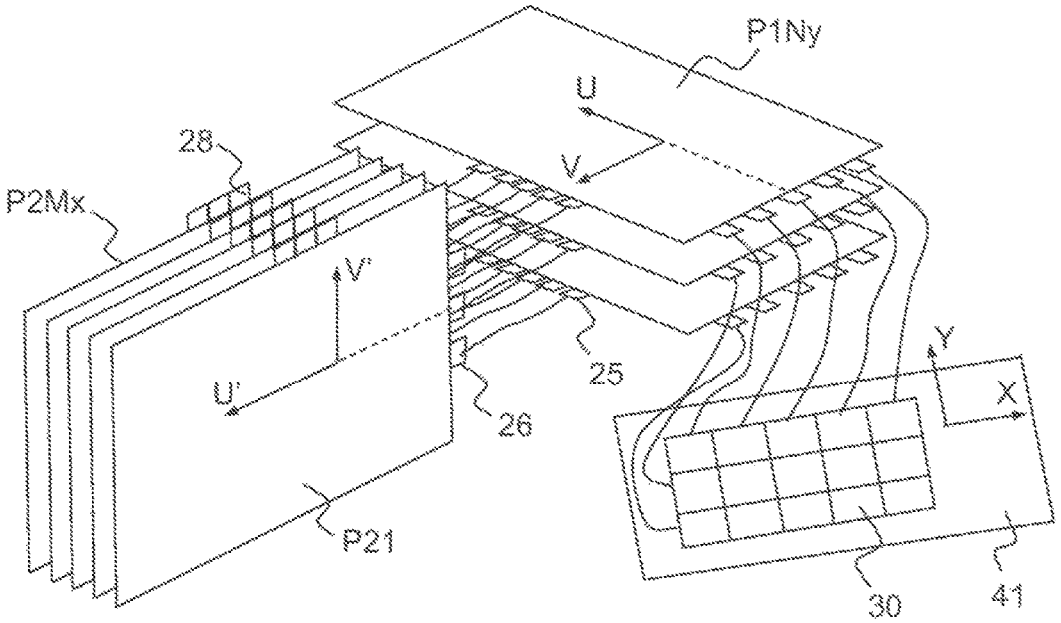
Figure 2A:
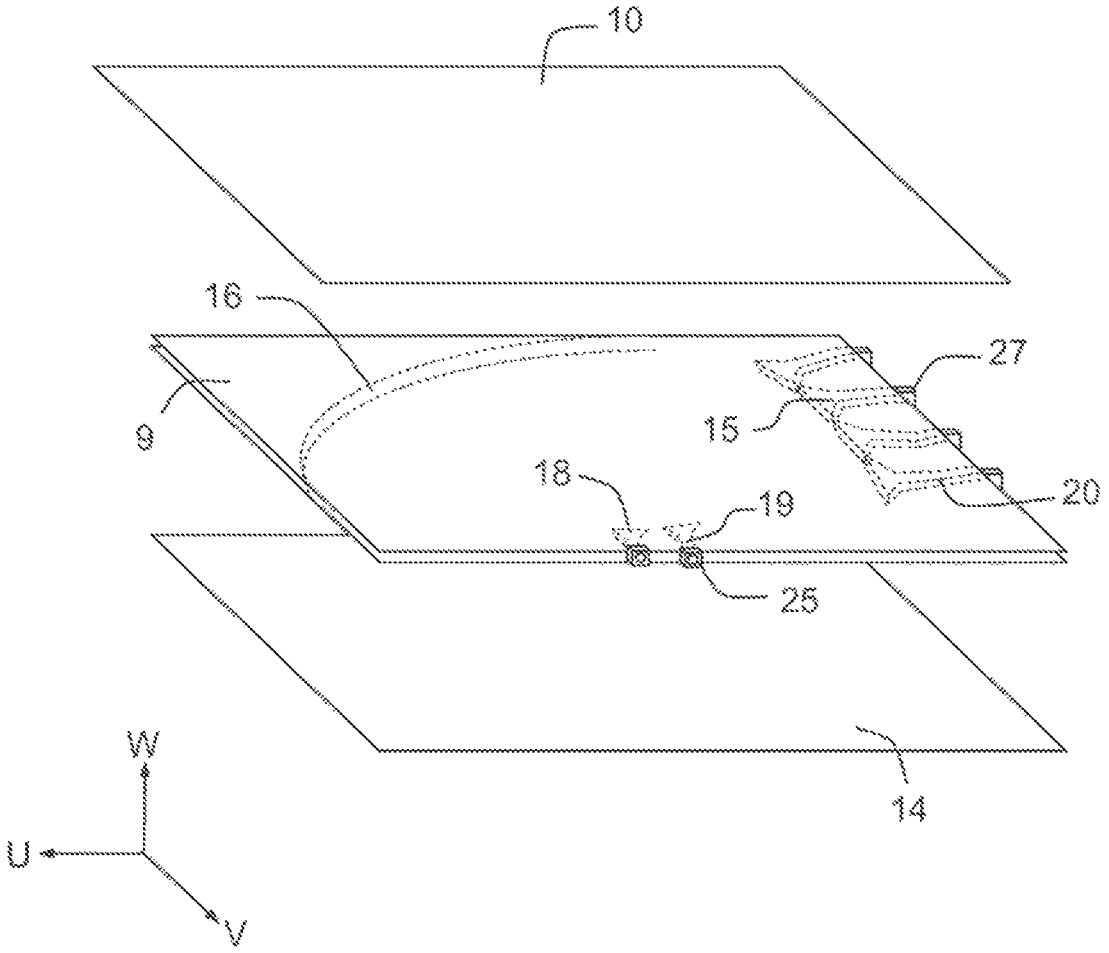
Figure 2B:
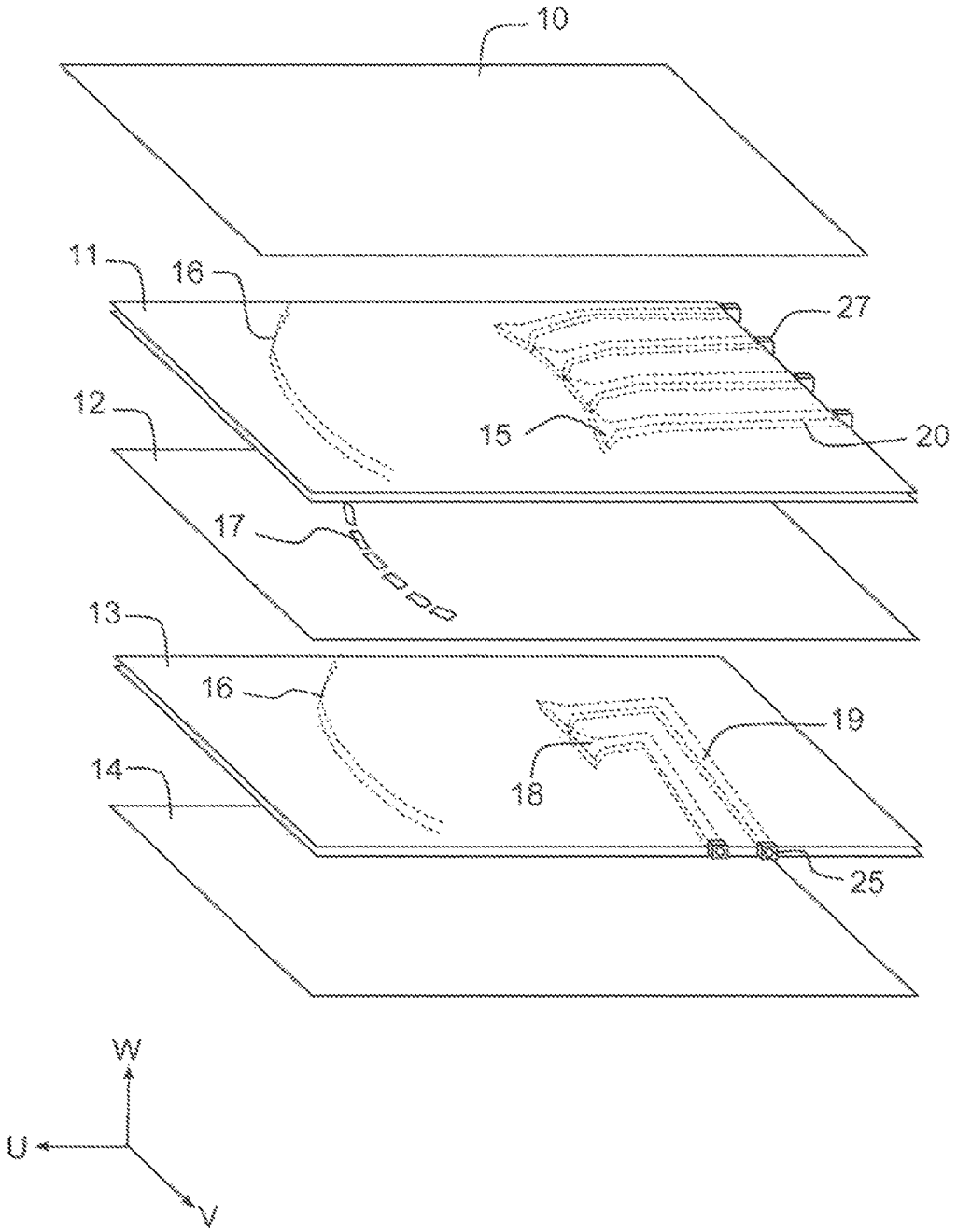
Figure 2C:
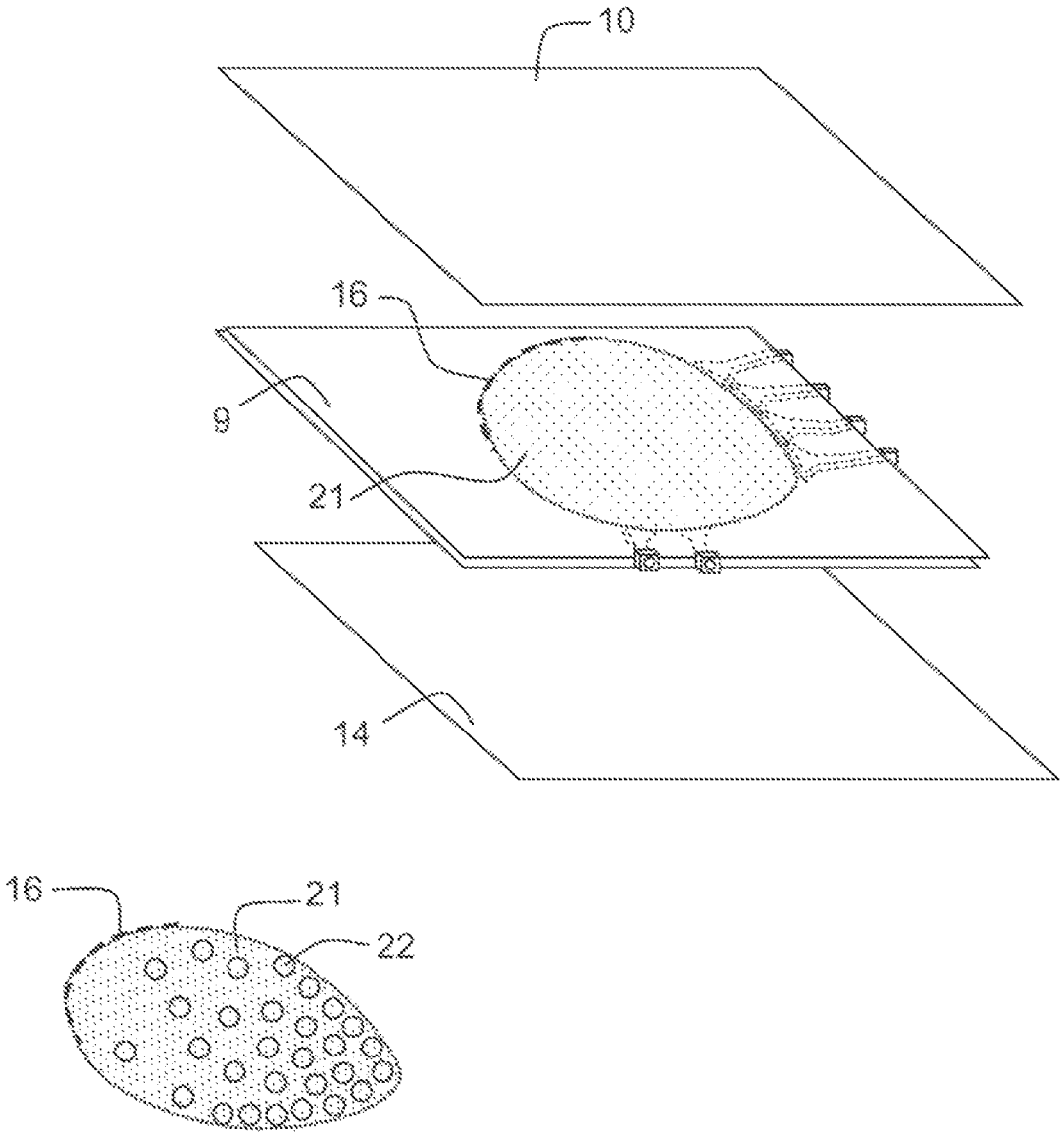
Figure 2D:
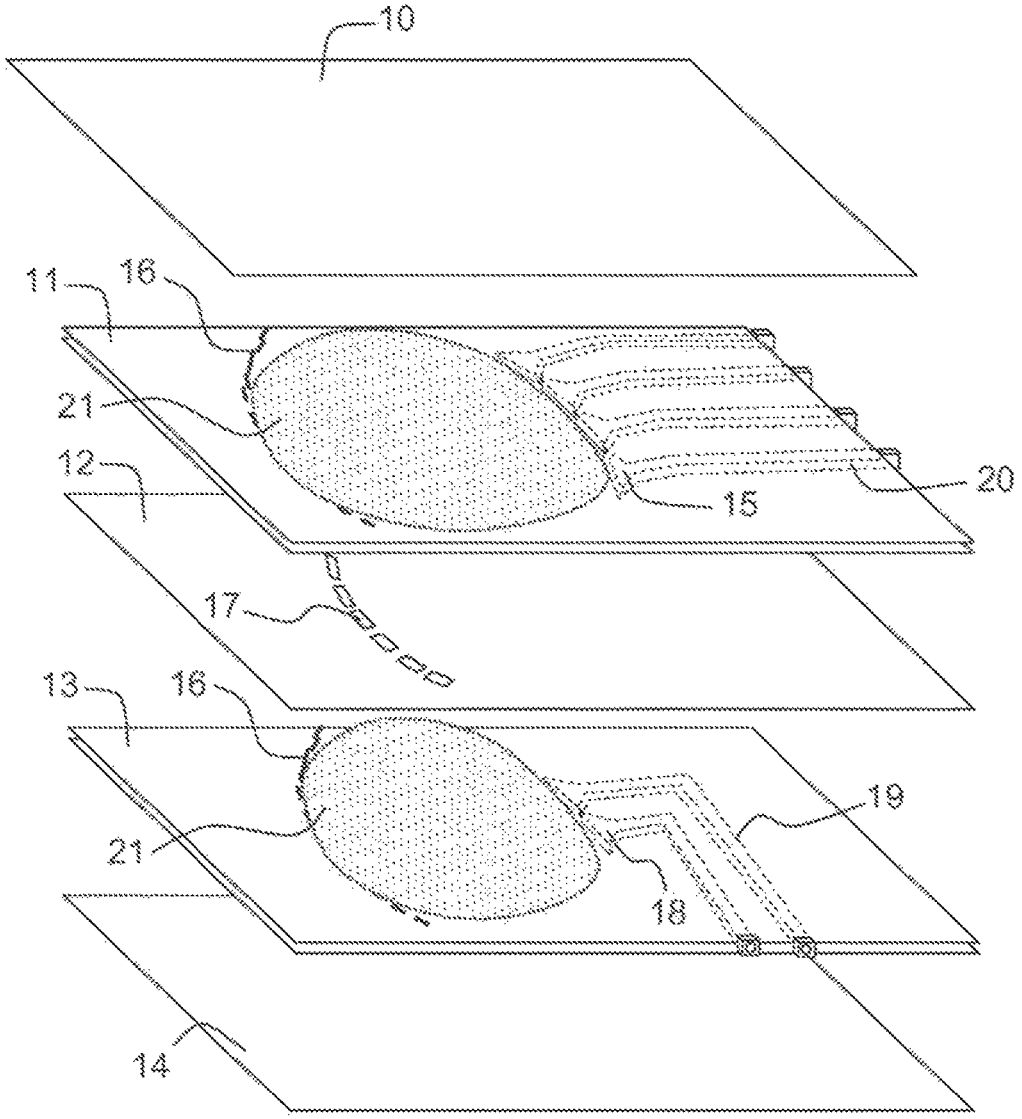
Figure 2D:
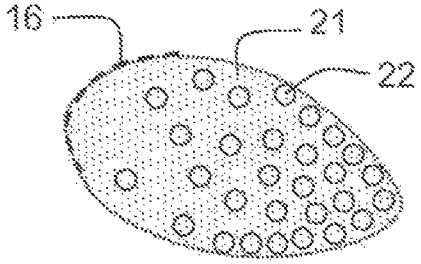
Figure 2E:
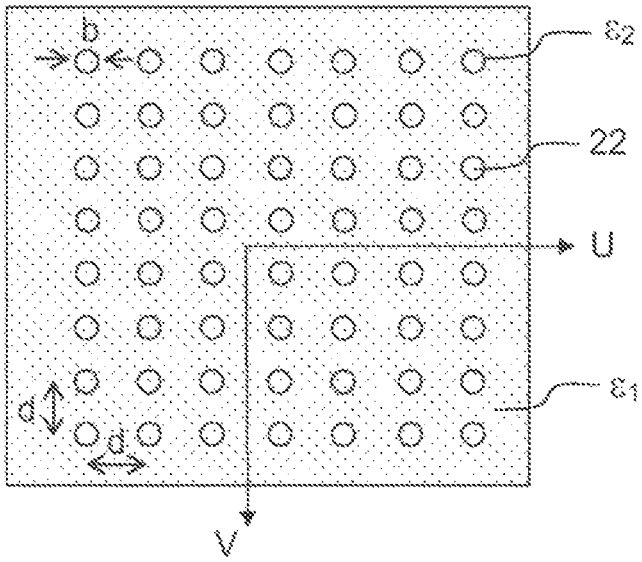
Figure 3:
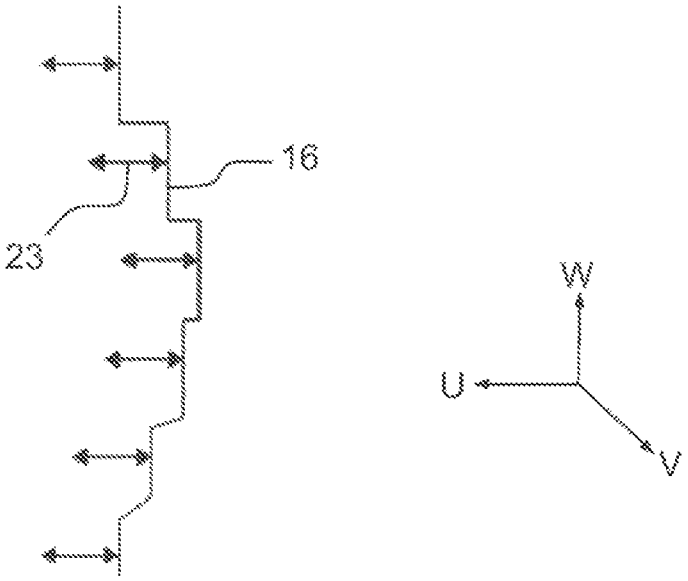

The invention also relates to a satellite telecommunication system comprising such an antenna. BRIEF DESCRIPTION OF THE DRAWINGS Other particular features and advantages of the invention will be clearly apparent in the subsequent description given by way of purely illustrative and nonlimiting example, with reference to the appended schematic drawings which represent:

FIG. 1*a*: a perspective diagram of an exemplary two-dimensional multi-beam former BFN, according to the invention;

FIG. 1*b*: a diagram of an example of connections between the multi-beam former of FIG. 1*a* and a phased array, according to the invention;

FIG. 2*a*: an exploded diagram, in perspective, of a first exemplary multi-layer structure of a BFN slice, according to the invention;

FIG. 2*b*: an exploded diagram, in perspective, of a second exemplary multi-layer structure of a BFN slice, according to the invention;

FIG. 2*c*: an exploded diagram, in perspective, of a variant embodiment of the first exemplary multi-layer structure of a BFN slice, according to the invention;

FIG. 2*d*: an exploded diagram, in perspective, of a variant embodiment of the second exemplary multi-layer structure of a BFN slice, according to the invention;

FIG. 2*e*: a schematic view from above of an example of dielectric comprising inclusions of air holes, according to a variant embodiment of the invention;

FIG. 3: a sectional schematic example of a reflector comprising deformation means on its rear face.

Figure 4A:
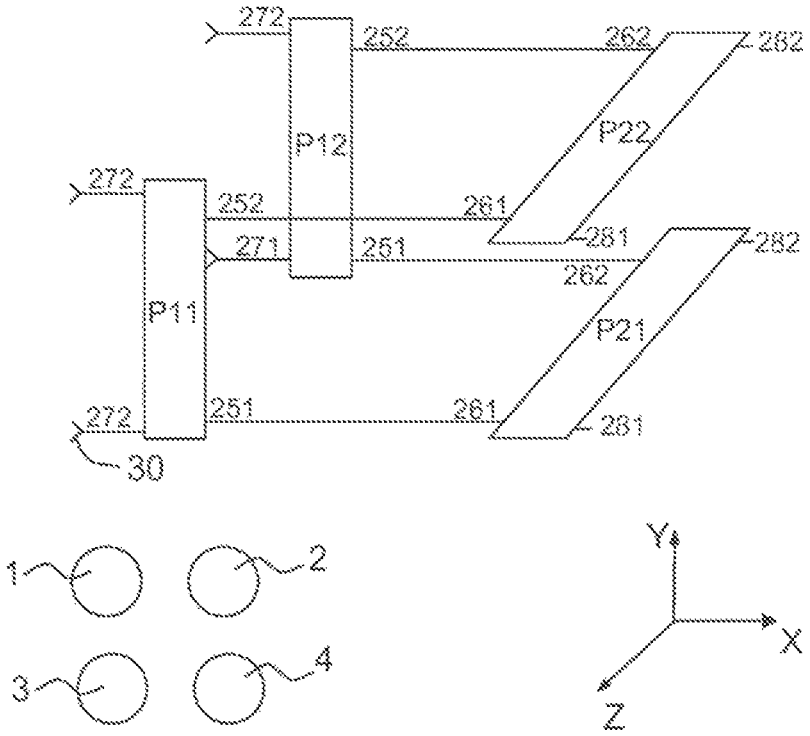
Figure 4B:
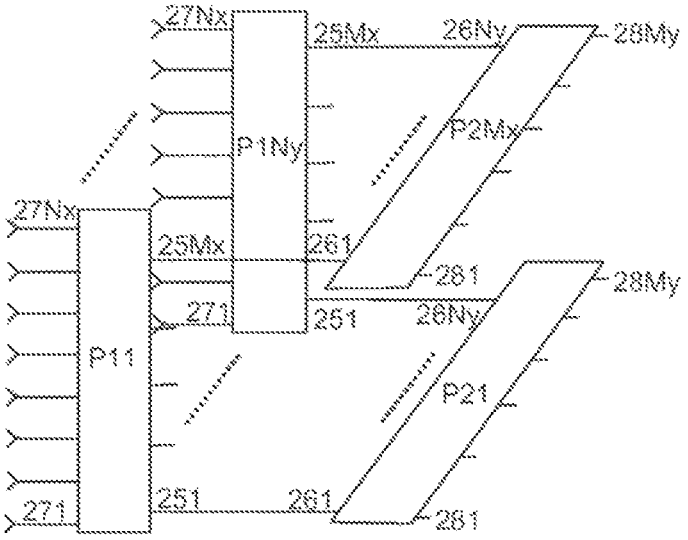
Figure 5A:
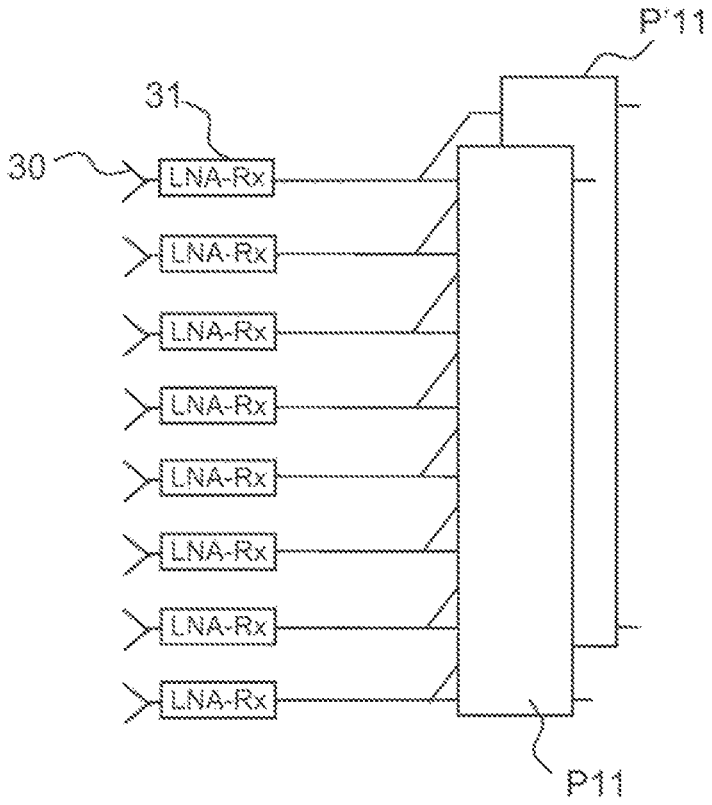
Figure 5B:
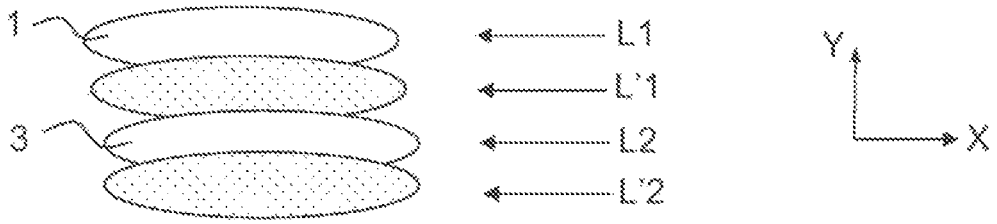
Figure 5C:
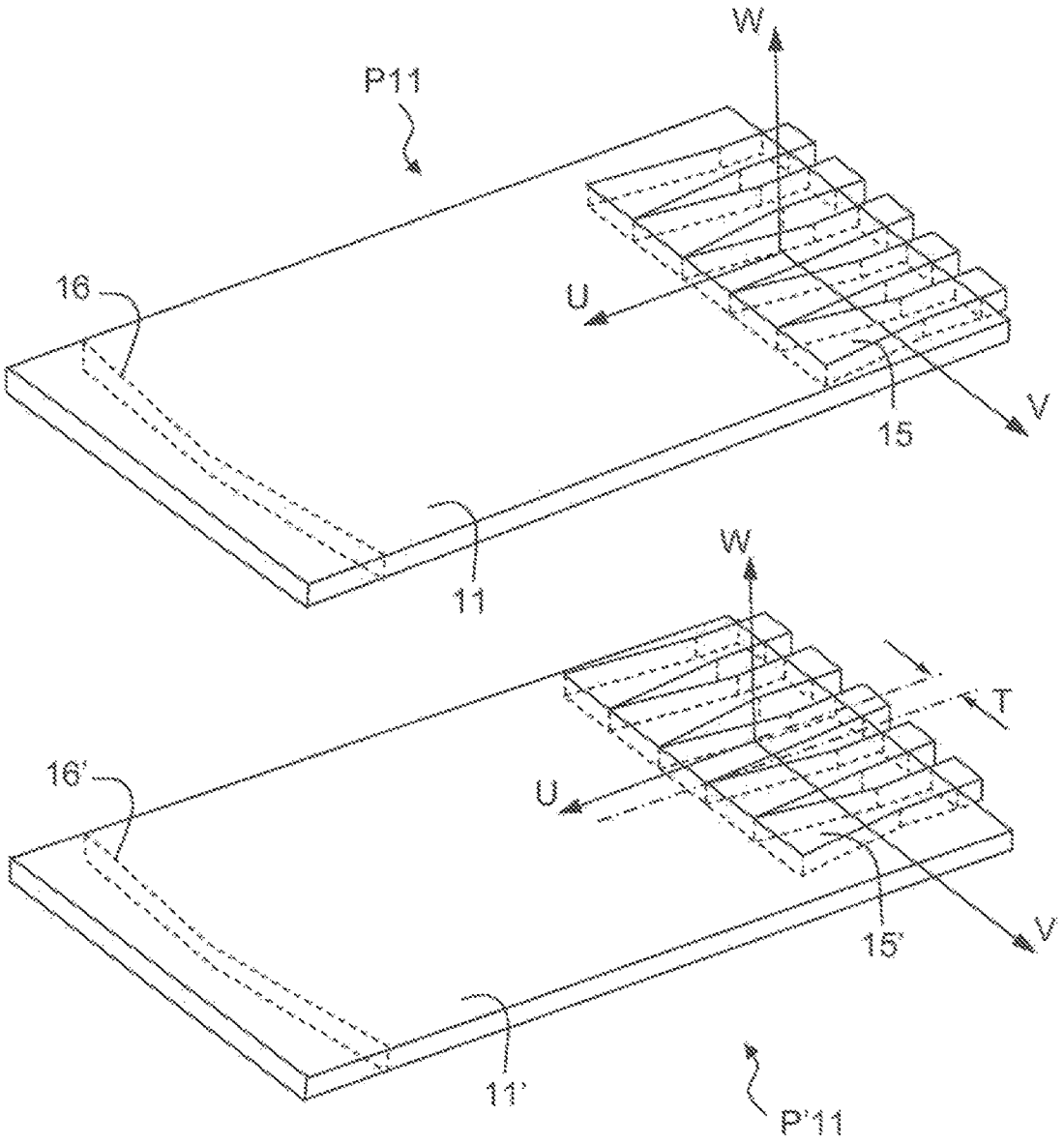
Figure 6:
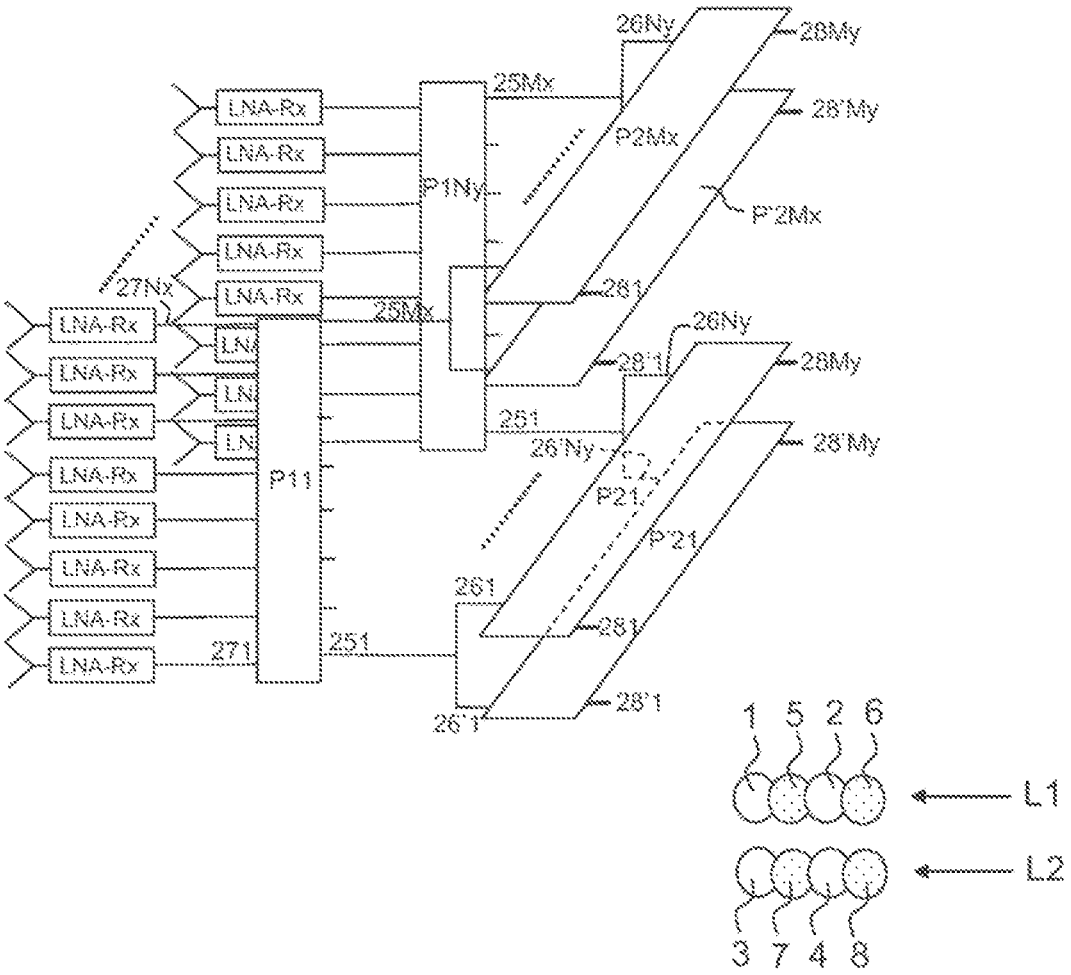
Figure 7A:
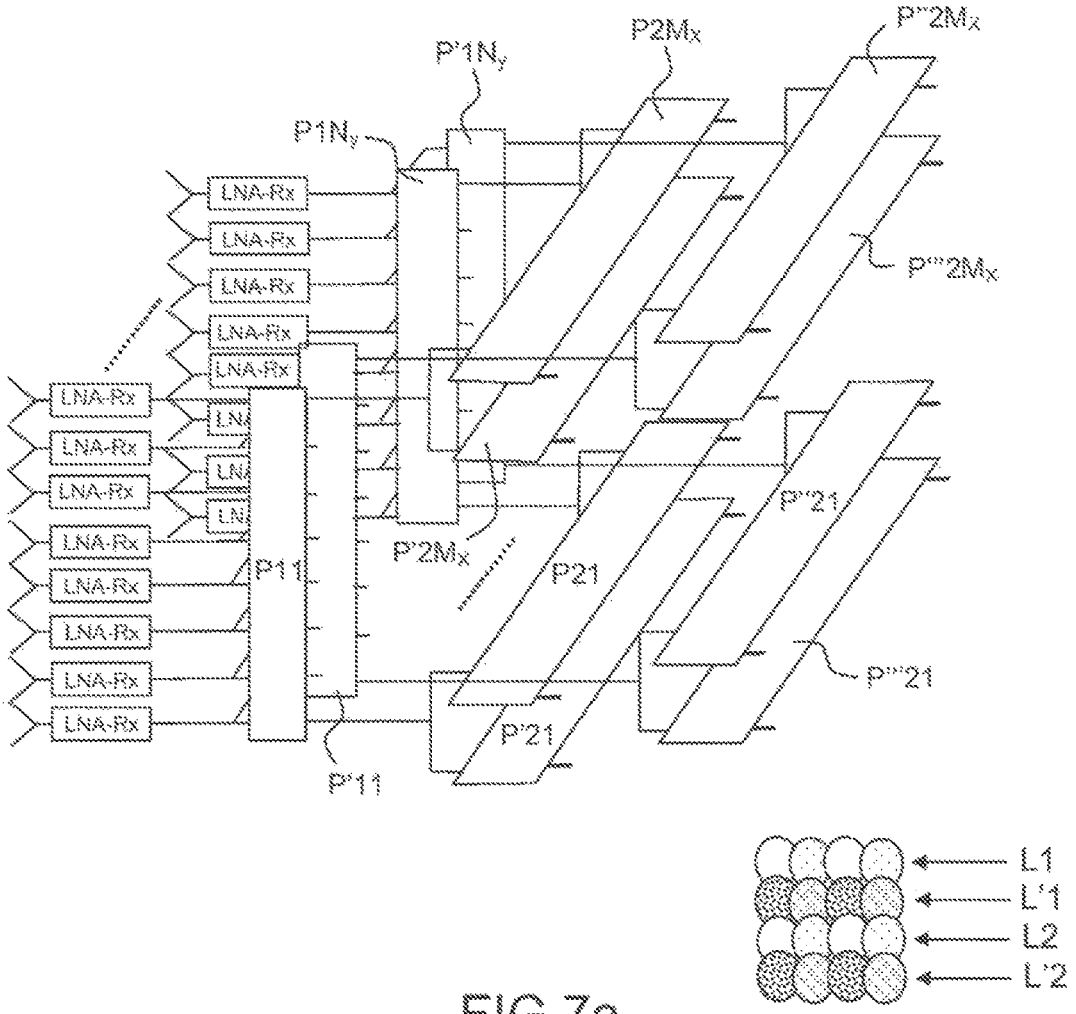
Figure 7B:
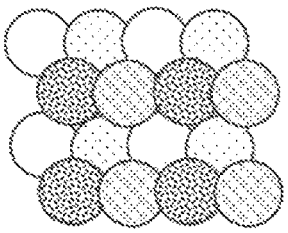
Figure 8A:
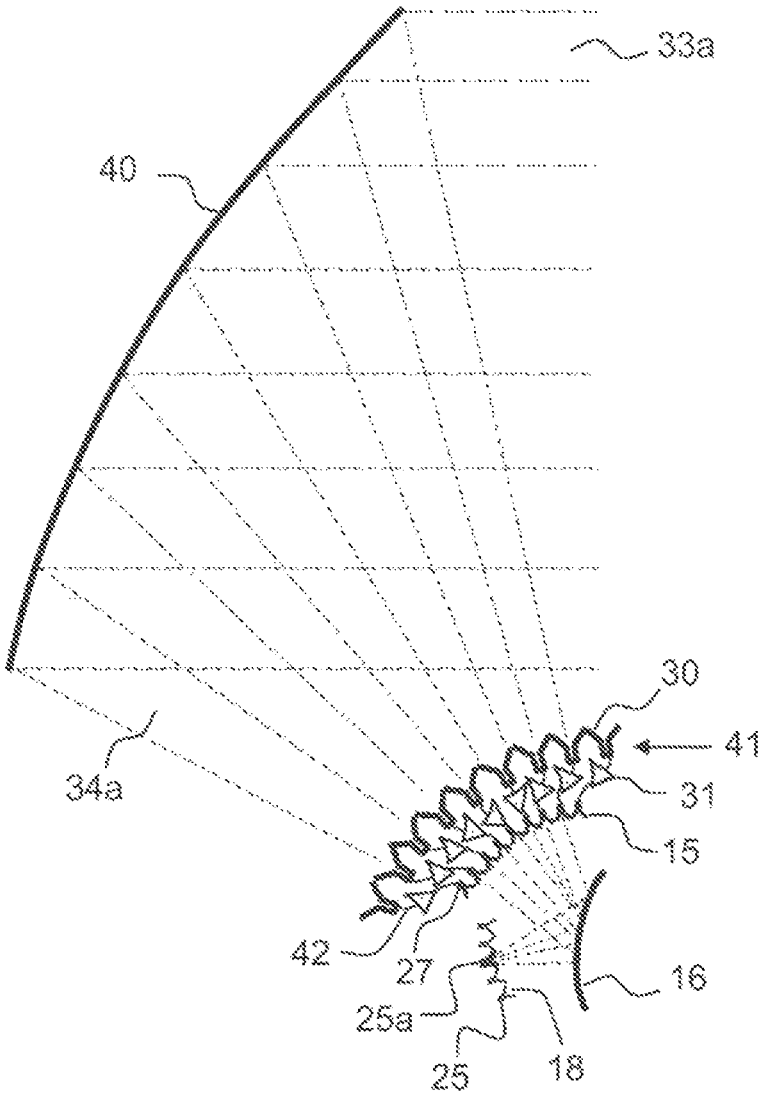
Figure 8B:
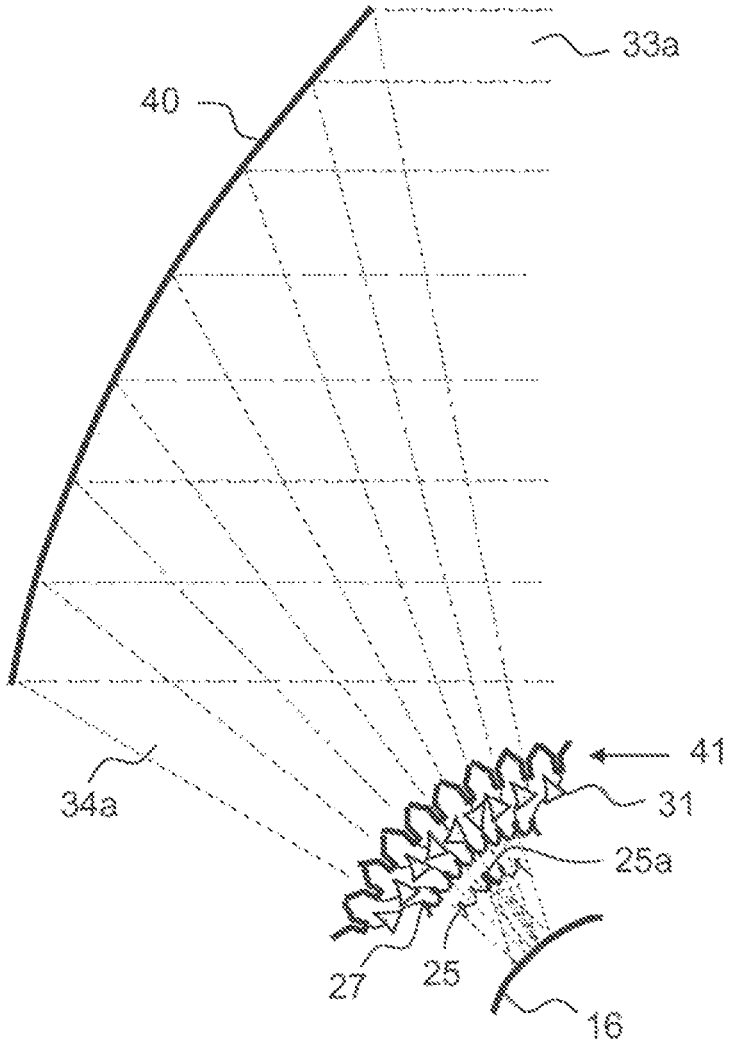
Figure 8C:
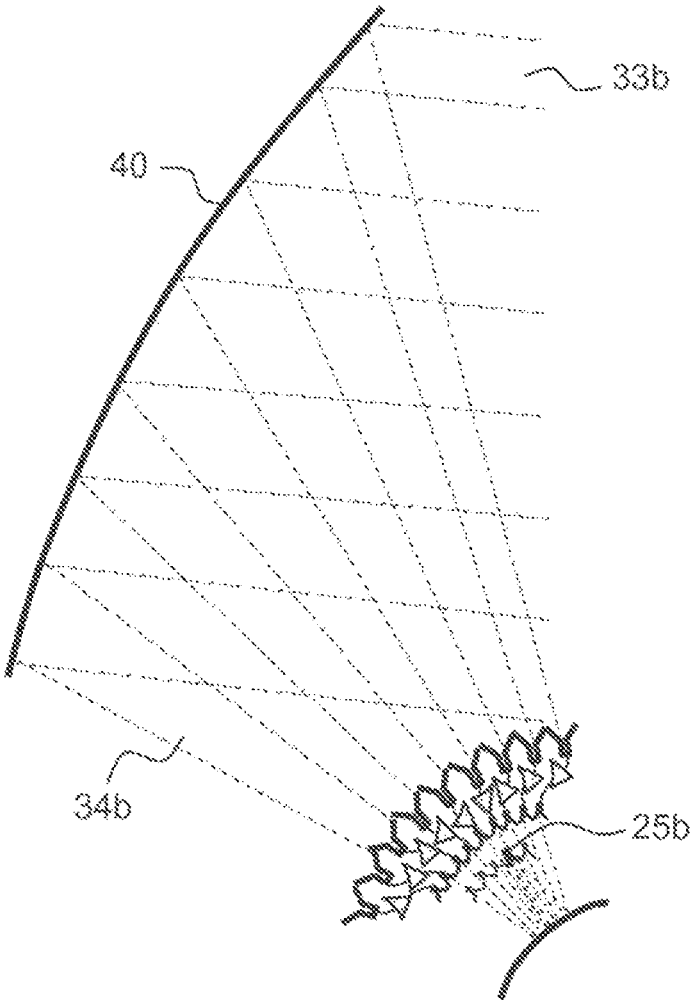
Figure 8D:
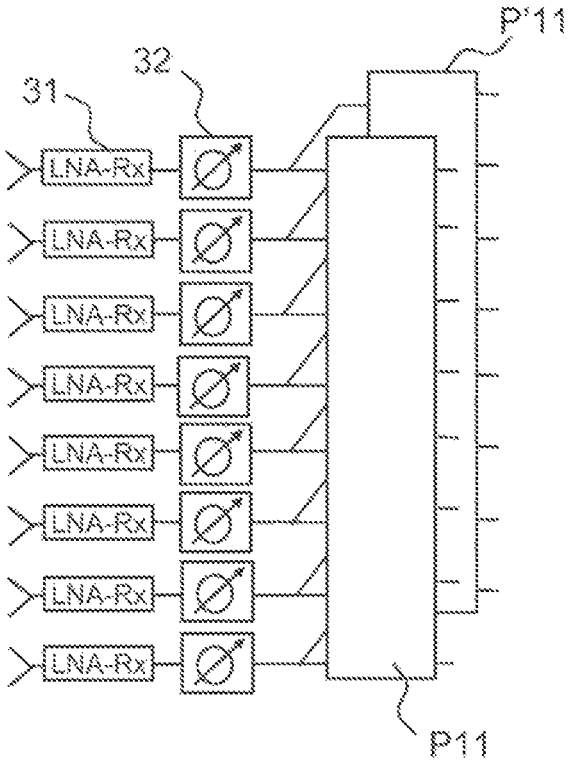
Figure 9:
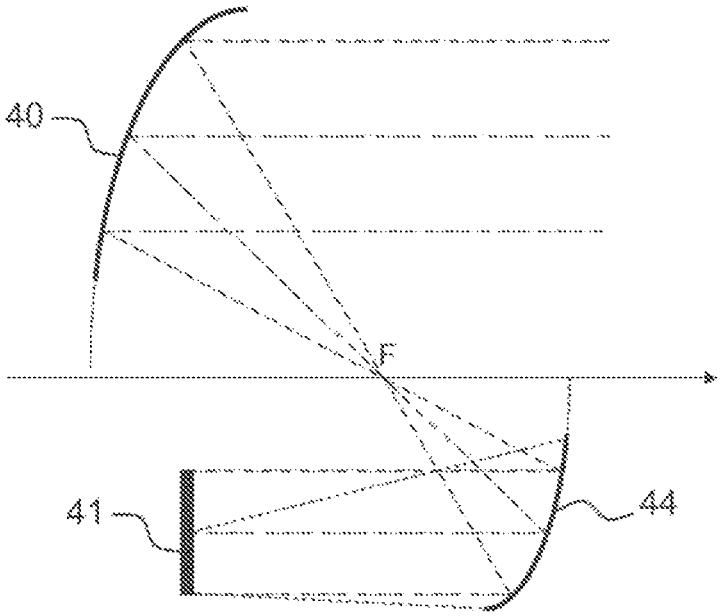

FIGS. 4*a* and 4*b*: two diagrams illustrating the connections between the BFN slices of the two beamforming stages;

FIGS. 5*a*, 5*b*, 5*c*: three diagrams illustrating a second exemplary two-dimensional multi-beam former making it possible to improve the overlap between the spots in the first direction in space, according to the invention;

FIG. 6: a diagram of a third exemplary two-dimensional multi-beam former making it possible to improve the overlap between the spots in the second direction in space, according to the invention;

FIG. 7*a*: a diagram of a fourth exemplary two-dimensional multi-beam former making it possible to improve the overlap between the spots in the first and in the second direction in space, according to the invention;

FIG. 7*b*: an example illustrating the overlap of the spots in the case of a hexagonal grid;

FIG. 8*a*: a diagram illustrating the operation of a first exemplary imaging array antenna comprising a multi-beam former, according to the invention;

FIGS. 8*b* and 8*c*: two diagrams illustrating the operation of a second exemplary imaging array antenna comprising a multi-beam former, according to the invention;

FIG. 8*d*: a diagram illustrating an example of emission and reception pathways connected to a multibeam former and comprising dynamic phase shifters, according to the invention;

FIG. 9: a diagram of a second exemplary embodiment of an imaging array antenna comprising a two-dimensional multi-beam former, according to the invention.

DETAILED DESCRIPTION

According to the exemplary embodiment of the invention represented in FIGS. 1*a* and 1*b*, the two-dimensional multi-beam former (or Beam Forming Netwok) comprises a first beamforming stage able, on emission, to form signal beams focused in a first dimension in space, for example parallel to an axis X and a second beamforming stage connected to the first beamforming stage, the second beamforming stage being able, on emission, to focus the beams formed by the first beamforming stage, in a second dimension in space, for example parallel to an axis Y. As represented in FIG. 1*b*, the axes X and Y are tied to the radiating elements 30 of a phased array 41 to which the multi-beam former is intended to be linked and may not be orthogonal. The orientation of these axes X and Y depends on the connections, represented partially in FIG. 1*b*, between the radiating elements of the phased array and the multi-beam former input/output ports 27 to which these radiating elements 30 are intended to be linked. In the exemplary embodiment represented in FIG. 1*b*, the phased array comprises a rectangular shaped mesh, but the invention is not limited to this mesh shape and can also apply to a phased array having for example a hexagonal or square shaped mesh.

The two beamforming stages comprise corresponding ports 25, 26 connected pairwise, called linking ports in the subsequent description. Each beamforming stage comprises at least two plane structures for forming beams, called BFN slices, P11 to P1NY and P21 to P2Mx, where Ny and Mx are integer numbers greater than one, the BFN slices being stacked in parallel one above another along an axis perpendicular to the plane U, V, respectively U', V', of the plane structure. Each BFN slice P1Nk of the first beamforming stage, where Nk is an integer number lying between 1 and Ny inclusive, comprises Nx input/output ports 27, where Nx is an integer number greater than one, intended to be connected to Nx radiating elements 30 of a phased array 41 of a multiple-beam antenna by way of emission and reception pathways for the emission of signal beams synthesized by the multi-beam former toward various zones of ground coverage and for the reception of signal beams stemming from various zones of ground coverage. Each BFN slice P2Mi of the second beamforming stage, where Mi is an integer number lying between 1 and Mx inclusive, comprises My input/output ports 28, where My is an integer number greater than one, intended on emission, to be connected to an RF signals feed and on reception, to receive the signals separated by the multi-beam former. The two-dimensional multi-beam former therefore comprises Nx*Ny input/output ports 27 intended to be connected to Nx*Ny radiating elements of an antenna and Mx*My input/output ports 28 intended to be linked to an RF signals feed and making it possible to form Mx*My ground spots. In the case of an embodiment produced with metallic waveguide technology, the input/output ports 27, 28 are waveguide inlets whereas in the case of an embodiment produced with integrated circuit technology, the input/output ports 27, 28 are connectors. The Ny BFN slices of the first stage P11 to P1NY and the Mx BFN slices of the second stage P21 to P2Mx of the multi-beam former have an identical structure and operate in the same manner but can have a different number of input/output ports 27, 28 and therefore a different number of emission/reception channels.

In the embodiment represented in FIGS. 1*a* and 1*b*, the two beamforming stages are disposed in two mutually perpendicular planes UV, U'V', but this is not indispensable. In order for the signal beams synthesized on emission by the beamformer to be focused in the two dimensions X, Y in space, it is on the other hand necessary to connect each linking port 25 of one and the same Nkth BFN slice P1Nk of the first beamforming stage to a corresponding Nkth linking port 26 of one of the various BFN slices P21 to P2Mx of the second beamforming stage.

FIG. 2*a* represents an exploded diagram, in perspective, of an exemplary BFN slice, according to a first embodiment of the invention. In this example, the BFN slice comprises a multi-layer plane structure comprising two parallel metallic planes, respectively lower 14 and upper 10, and a substrate layer 9 inserted between the two metallic planes, lower and upper, 14, 10. The two metallic planes and the substrate layer of the BFN slice are parallel to a plane UV. The multi-layer structure thus constructed forms a propagation medium in so-called tri-plate configuration. The height of the BFN slice is disposed along an axis W orthogonal to the plane UV. The substrate layer 9 comprises two arrays of input/outputs ports 27, 25, depending on whether the BFN slice is used on emission or on reception, disposed orthogonally along the axes V and U. In the example of FIG. 2*a*, the two arrays of input/outputs ports comprise respectively four input/output ports 27 aligned along the direction V and two input/output ports 25 aligned along the direction U. The input/output ports 25, 27 are coupled by way of an internal reflector 16 disposed transversely in the substrate layer 9, the internal reflector 16 extending from the lower metallic plane 14 to the upper metallic plane 10. Each input/output port 27, 25 is connected to a waveguide 20, 19 linked to an internal source 15, respectively 18. The waveguides 20, 19 can extend in parallel alongside one another or be spaced apart and they can have a rectangular cross section or a curved profile. The internal sources 15, 18 can be aligned alongside one another or disposed along a curved contour so as to optimize the performance of the multi-beam antenna.

FIG. 2*b* represents an exploded diagram, in perspective, of an exemplary BFN slice, according to a second embodiment of the invention. In this example, the BFN slice has a multi-layer plane structure of Pill-box type. It comprises three parallel metallic planes, respectively lower 14, intermediate 12 and upper 10, a first substrate layer 11 and a second substrate layer 13, each substrate layer 11, 13 being respectively inserted between two successive parallel metallic planes, the intermediate metallic plane 12 separating the two substrate layers 11, 13. The planes of the various layers of the BFN slice are parallel to a plane UV. The multi-layer structure thus constructed forms two propagation media in so-called tri-plate configuration, each tri-plate propagation medium comprising a substrate layer disposed between two metallic planes. The height of the BFN slice is disposed along an axis W orthogonal to the plane UV. The two substrate layers 11, 13 are coupled by an internal reflector 16 disposed transversely in the two substrate layers 11, 13 of the BFN slice, the internal reflector 16 extending from the lower metallic plane 14 to the upper metallic plane 10, and by way of an aperture or of several coupling slots 17 extending along the internal reflector 16 and made in the intermediate metallic plane 12 separating the two substrate layers 11, 13.

The multi-layer structure comprises two arrays of input/output ports, depending on whether the BFN slice is used on emission or reception, disposed orthogonally along the axes U and V. In the example of FIG. 2*b*, the two arrays of input/output ports comprise respectively four input/output ports 27 aligned along the direction V and two input/output ports 25 aligned along the direction U. Each input/output port 27, 25 is connected to a waveguide 20, 19 linked to an internal source 15, 18. The waveguides 19 of the second substrate layer 13 are preferably bent at 90°, so as to link input/output sources 18 and input/output ports 25 disposed along orthogonal axes.

Each BFN slice can operate in emission or in reception. In reception, the input/output ports 27 are intended to receive an incident RF signal and to re-emit it in the first tri-plate propagation medium of the BFN slice which combines the signals re-emitted by all the first internal sources 15. The internal reflector 16 reflects the combined signal and focuses it in its focal plane on one of the second internal sources 18 of the BFN slice as a function of the direction of arrival of the incident signal.

On emission, an excitation signal is applied to one of the second internal sources 18 of the BFN slice, and then reflected on the internal reflector 16. The energy of the signal reflected by the internal reflector 16 propagates in the tri-plate propagation medium and is then distributed over all the first internal sources 15 of the BFN slice. The first internal sources 15 transmit this energy in the form of signal beams to the first input/output ports 27 to which they are respectively linked.

The input/output ports 27 linked to the first internal sources 15 being disposed on one and the same line parallel to the direction V, the signal beams emitted on each first input/output port 27 of the BFN slice are focused along a single dimension in space, for example parallel to the direction Y, and form a line of ground coverage zones called spots. The number of spots formed on the ground is equal to the number of input/output ports 25 placed in the focal plane of the internal reflector 16 of the BFN slice.

In FIG. 2*b*, four input/output ports 27 in the first substrate layer 11 and two input/output ports 25 in the second substrate layer 13 are represented, thereby making it possible to construct two different beams corresponding to two different directions of pointing and to the formation of two ground spots.

The input/output ports 27 linked to the first internal sources 15 of one and the same BFN slice being disposed along one and the same line, the spots formed on the ground by a BFN slice are aligned.

The substrate layer 9 or the first and second substrate layers 11, 13 of the BFN slice can comprise a dielectric. In this case, the BFN slice can be produced using PCB printed circuit board technology. According to this technology, known by the name SIW (Substrate Integrated Waveguide) or by the name laminated, the internal reflector 16, the transverse walls of the first internal sources 15, and if appropriate of the second internal sources 18, and the transverse walls of the waveguides 19, 20 are produced as regular arrangements of metallized holes passing through the substrate layer or layers 9, 11, 13 and linking the upper 10 and lower 14 metallic plates, respectively the upper 10 and intermediate 12 plates and/or the intermediate 12 and lower 14 plates. The use of tri-plate dielectric propagation media makes it possible to obtain a very compact multi-beam former of reduced bulk. The excitations of the input/output ports of the internal RF sources are then produced through transitions. However, this technology induces propagation losses which must be compensated for by amplifiers disposed upstream of the first internal sources 15 of the BFN slice.

According to a particularly advantageous variant embodiment of the invention, the substrate layer 9 or the first and second substrate layers 11, 13 of the BFN slice can comprise a dielectric medium having a dielectric permittivity gradient, the dielectric permittivity decreasing progressively from the internal reflector 16 to the first internal sources and second internal sources 15, 18. By way of nonlimiting example, as represented in FIG. 2*c*, the dielectric permittivity gradient can be obtained by using a dielectric material having a first dielectric permittivity $\in_1$ and comprising inclusions 22 of a different dielectric material having a second dielectric permittivity $\in_2$ lower than the first dielectric permittivity $\in_1$. So as not to disturb the propagation of the signals intended to propagate in the BFN slice, the inclusions 22 must have dimensions b that are less than the wavelength of said signals and the distances d separating two consecutive inclusions must be less than the wavelength of said signals. The density of the inclusions increases from the reflector 16 to the first internal sources and the second internal sources 15, 18 of the BFN slice so that the dielectric permittivity decreases continually on approaching the first internal sources and second internal sources 15, 18.

When the BFN slice is embodied using SIW technology, the dielectric permittivity gradient can be obtained for example by inclusions 22 of air holes made in the dielectric medium. In this case, the air holes are not metallized and can be embodied as drillings emerging through the upper metallic plate 10, the density of the air holes increasing from the reflector 16 to the first internal sources and the second internal sources 15, 18 of the BFN slice so as to decrease the dielectric permittivity near the internal sources. In this case, the metallic deposition of the upper metallic plate 10 having been destroyed locally by the drilling of the air holes, it is necessary to carry out an additional deposition of a dielectric layer above the upper metallic plate 10 and a deposition of an additional metallic layer above the additional dielectric layer so as to regain the leaktightness of the propagation medium.

Advantageously, the dielectric permittivity gradient can be obtained by using a dielectric medium consisting for example of a dielectric lens 21 with convex periphery, having a dielectric permittivity $\in_1$ greater than the dielectric permittivity of the air, and comprising inclusions 22, as represented for example in FIGS. 2*d* and 2*e*. The inclusions 22 can for example be inclusions of air holes, the diameter and/or the density of the inclusions 22 increasing progressively from the internal reflector to the internal sources 15, 18.

The use of a dielectric medium having a permittivity gradient in the first and second substrate layer or layers 9, 11, 13 of the BFN slice exhibits the advantage of curving the direction of propagation of the signals and therefore of being able to use less directional first internal sources and second internal sources 15, 18. It then becomes possible to tighten the synthesized beams. The first internal sources and the second internal sources 15, 18 are then of reduced size, the multi-beam former is more compact and the overlap of the synthesized beams is better.

Advantageously, each BFN slice can comprise deformation means making it possible to modify the shape of the reflector 16 internal to the multi-layer structure of said BFN slice, as represented for example in FIG. 3. These deformation means can for example comprise a set 23 of pistons associated with actuators, the pistons being regularly distributed over the rear face of the reflector 16, the rear face being the opposite face of the reflector from the face reflecting the RF waves. The means of deformation of the reflector 16 thus make it possible to optimize the shape of the internal reflector 16 and to effectively ensure the focusing of the signals, on the second sources 18 of each BFN slice, as a function of their direction of arrival on the first internal sources 15. The means of deformation of the reflector 16 also make it possible to produce beams with shaped contours of any previously chosen shape. The deformations of the internal reflector may, for example, be different from one BFN slice to another BFN slice so as to produce beams of contours of different shapes.

In FIGS. 4*a* and 4*b*, the first stage of the beamformer comprises Nx*Ny input/output ports of signal beams intended to be connected to Nx*Ny radiating elements 30 of a multi-beam antenna. The second stage of the beamformer comprises Mx*My input/output ports of signals making it possible, on emission, to form Mx*My beams focused in the two directions X and Y in space, which beams correspond to Mx*My ground spots. Nx, Ny, Mx, My are integer numbers greater than 1.

The first beamforming stage comprises Ny BFN slices, P11, . . . , P1Ny, superposed one above the other, each BFN slice P1Nk of the first stage comprising Nx input/output ports, 271 to 27Nx, of signal beams and Mx linking ports, 251 to 25Mx, connected respectively to Mx BFN slices, P21 to P2Mx, of the second stage.

The second beamforming stage comprises Mx BFN slices, P21 to P2Mx, superposed one above the other, each BFN slice P2Mi of the second beamforming stage comprising Ny linking ports, 261 to 26Ny, connected respectively to the Ny BFN slices, P11 to P1 Ny, of the first stage and My input/output ports 281 to 28My intended, on emission, to be fed with excitation signals, and on reception, to receive signals focused in the two space dimensions X and Y by the two stages of the multi-beam former. In the example of FIG. 4*a*, Nx, Ny, Mx and My are equal to two and make it possible to form two lines of two beams corresponding to four ground spots, 1 to 4.

The Ny BFN slices, P11 to P1Ny, of the first stage comprise Ny*Mx linking ports connected respectively to Mx*Ny corresponding linking ports of the Mx BFN slices, P21 to P2Mx, of the second stage. As shown by FIG. 4*b*, the first BFN slice, P11, of the first stage comprises Mx linking ports, 251 to 25Mx, linked to the first linking ports 261 of each of the Mx BFN slices, P21 to P2Mx, of the second stage, and so on and so forth; each Nkth BFN slice P1Nk of the first stage comprises Mx linking ports linked to the Nkth linking port 26Nk (not represented) of each of the Mx BFN slices, P21 to P2Mx, of the second stage, up to the last BFN slice, P1Ny, of the first stage which comprises Mx linking ports linked to the last linking ports, 26Ny, of each of the Mx BFN slices, P21 to P2Mx, of the second stage.

In the exemplary embodiment represented in FIGS. 1*a* and 1*b*, the first beamforming stage comprises three BFN slices, each BFN slice comprising five input/output ports and five linking ports. The second beamforming stage comprises five BFN slices, each BFN slice comprising three input/output ports and three linking ports, the five linking ports of each BFN slice of the first beamforming stage being respectively connected to one of the three corresponding linking ports of the five different BFN slices of the second stage. This beamformer makes it possible to synthesize 3*5=15 different beams focused in the two directions X and Y in space.

The two-dimensional multi-beam former can operate in emission and/or in reception. It is possible to use a single beamformer operating on emission and on reception or alternatively to use two different beamformers, one operating on emission and the other on reception. In the case where a single beamformer is used for the emission and the reception of signals, the switch between emission and reception can be effected for example, either on the basis of the frequencies of the signals, the emission frequencies and the reception frequencies lying in different frequency bands, or by a predetermined temporal sequencing, or by any other known procedure.

In reception, the first internal sources 15 receive a signal transmitted by the radiating elements 30 of a phased array and re-emit the signal energy received in each BFN slice of the first beamforming stage. In the BFN slices of the first beamforming stage, the energy is focused a first time, in a first dimension in space, on one of the second sources 18 of the first stage by way of the internal reflector 16; the second source 18 which collects the focused energy depends on the direction of arrival of the signal. The signal focused in the first dimension in space is thereafter transmitted to one of the first internal sources 15 of each BFN slice of the second beamforming stage. In each BFN slice of the second stage, the beam is focused a second time, in the same manner as in the first stage, in a second dimension in space perpendicular to the first dimension in space, on one of the second sources 18 of one of the BFN slices of the second stage and transmitted to the input/output port 28 to which it is linked. The BFN slices of the second stage having a structure identical to that of the BFN slices of the first stage, beam focusing is effected according to the same principle in both stages.

On emission, an excitation signal is applied to one of the input/output ports 28 of the second beamforming stage and transmitted, by way of the second source 18 to which it is connected, inside the corresponding BFN slice. In the BFN slice, the signal is guided in the waveguide 19 linked to the second source 18 and then reflected on the internal reflector 16. The energy reflected by the internal reflector 16 is thereafter distributed over all the first sources 15 of the BFN slice of the second stage and then transmitted to one of the second sources 18 of each BFN slice of the first stage to which the first sources 15 of the BFN slice of the second stage are respectively connected. The energies of the signal beams transmitted to the second sources 18 of the BFN slices of the first stage are thereafter reflected by the internal reflector 16 of the BFN slices of the first stage and then distributed over all the first sources 15 of the BFN slices of the first beamforming stage. The signal beams synthesized by the beamformer are then transmitted to all the phased array radiating elements 30 to which the first sources 15 of the first beamforming stage are connected and then the signal beams are emitted toward zones of ground coverage constituting the spots.

To obtain good ground coverage, it is necessary that two consecutive spots partially overlap. If the overlap between two consecutive spots is insufficient, as represented for example in FIG. 4*a* which shows four spots, 1 to 4, spaced apart and not overlapping, the ground coverage exhibits holes. To improve the overlap between the spots, the invention consists in adding extra BFN slices making it possible to obtain extra spots between two initial consecutive spots of one and the same line and/or to produce additional lines of spots inserted between two initial lines of spots.

The exemplary embodiment illustrated schematically in FIG. 5*a* represents two BFN slices of the first beamforming stage connected to the same radiating elements. This exemplary embodiment comprising only a single beamforming stage, the corresponding beams 1 and 3 are focused in a single direction Y and correspond to two lines of spots L1 and L2 widened in the direction X where there is no focusing of the beams. According to this exemplary embodiment, as represented in FIG. 5*b*, additional lines of spots L'1, L'2, parallel to the direction Y, are added to two lines of spots L1, L2, by using twice as many BFN slices of the first beamforming stage as there are radiating elements of the defocused array and by connecting two different BFN slices, P11, P'11, of the first beamforming stage to each of the radiating elements 30 of the defocused array 41. For a reception antenna, the addition of the extra BFN slices P'11 makes it necessary to place a signal divider at the output of the radiating elements 30 of the phased array, thereby inducing losses which must be compensated for by an amplifier.

To obtain additional lines of spots L'1 and L'2, it is furthermore necessary that the second BFN slice P'11 exhibits a linear shift, for example of half a mesh, a mesh corresponding to the spacing between two first internal sources 15', with respect to the first BFN slice P11 as regards the respective position of the first internal sources 15' with respect to the corresponding internal reflector 16'. The linear shift can be obtained either by applying a translation to the first internal sources 15' of the second BFN slice, as represented schematically in FIG. 5*c*, or by applying a rotation to the internal reflector 16' of the second BFN slice to change its orientation, the position of the first internal sources 15' then not being modified. In FIG. 5*c*, the second BFN slice, P'11, of the first stage comprises first internal sources 15' shifted linearly along the axis V perpendicular to the longitudinal direction U of the BFN slice with respect to the first internal sources 15 of the first BFN slice, P11, of the first stage connected to the same radiating element 30. The linear shift corresponds to a translation of all the first internal sources 15' by one and the same distance T of less than the distance between the centers of two first consecutive sources 15. The linear shift T may for example be equal to half the distance between the centers of two first consecutive sources, that is to say to half a mesh. In the case of a beamformer with two stages, the second beamforming stage, not represented in FIG. 5*a*, also comprises twice as many BFN slices, each BFN slice of the second stage being connected to the whole set of BFN slices of the first stage by way of the linking ports, as indicated hereinabove in conjunction with FIGS. 4*a* and 4*b*.

In the exemplary embodiment of FIG. 6, the number of lines of spots is unchanged but additional spots 5, 6, 7, 8 are added in each line of spots, L1, L2, each additional spot being inserted between two initial consecutive spots 1, 2, 3, 4, so as to fill in holes of ground coverage in each spot line. Accordingly, only the number of BFN slices of the second beamforming stage is doubled; the number of BFN slices of the first stage is not changed. Each linking port, 251 to 25Mx, of the BFN slices, P11 to P1Ny, of the first stage is then linked to a linking port, 261 to 26Ny, of a first BFN slice, P21 to P2Mx, of the second beamforming stage and to a linking port, 26'1 to 26'Ny, of a second BFN slice, P'21 to P'2Mx, of the second stage. As in the case described in conjunction with FIG. 5*c*, the second BFN slice, P'21 to P'2Mx, of the second stage comprises first internal sources 15' shifted linearly along the axis V perpendicular to the longitudinal direction U of the second BFN slice with respect to the first internal sources 15 of the first BFN slice, P21 to P2Mx, of the second stage connected to the same linking port of the first beamforming stage. Alternatively, the positions of the first internal sources are identical for the first BFN slice P21 to P2Mx and the second BFN slice P'21 to P'2Mx of the second stage but the internal reflector 16' of the second BFN slice P'21 to P'2Mx of the second stage is shifted angularly with respect to the reflector 16 of the first slice P21 to P2Mx of the second stage.

In the exemplary embodiment of FIG. 7*a*, additional spots and additional lines are added. For the addition of the additional lines L'1 and L'2, the number of BFN slices of the first beamforming stage and the number of BFN slices of the second beamforming stage are doubled as indicated in conjunction with FIG. 5*a* and furthermore, for the addition of the additional spots in each line of spots L1, L2, L'1, L'2, the number of BFN slices of the second beamforming stage is doubled once again, as indicated in conjunction with FIG. 6. In total, the number of BFN slices of the first stage P11 to P1Ny, P'11 to P'1Ny is doubled and the number of BFN slices of the second stage P21 to P2Mx, P'21 to P'2Mx, P"21 to P"2Mx, P'"21 to P'"2Mx is quadrupled.

The various exemplary embodiments have been described by considering a rectangular grid of spots. A hexagonal grid, as represented for example in FIG. 7*b*, may also be produced with the same configuration of the two beamforming stages as that represented in the exemplary embodiment of FIG. 7*a*. Accordingly, it is necessary either to shift, by half a mesh, the first internal sources of the additional BFN slices P"21 to P"2Mx and P'"21 to P'"2Mx, or to shift the second internal sources of the additional BFN slices P"21 to P"2Mx and P'"21 to P'"2Mx, or to modify the orientation of the internal reflector 16 of these additional BFN slices P"21 to P"2Mx and P'"21 to P'"2Mx.

FIGS. 8*a*, 8*b* and 8*c* represent three diagrams illustrating the operation of a first example (FIG. 8*a*) and of a second example (FIGS. 8*b* and 8*c*) of imaging array antenna comprising a main reflector 40, a defocused phased array 41 placed in front of the main reflector 40 and a multi-beam former according to the invention. To simplify FIGS. 8*a* to 8*c* and the corresponding description, in these three diagrams, the radiating array 41 considered is a linear array and a single BFN slice is considered for the formation of a beam. In FIG. 8*a*, the internal reflector 16 in the BFN slice is disposed in an offset configuration corresponding to the first embodiment of the BFN slice described in conjunction with FIG. 2*a*. In FIGS. 8*b* and 8*c*, the internal reflector 16 in the BFN slice reflects the signals in the same direction as the incident beam, thereby corresponding to the second embodiment of the BFN slice described in conjunction with FIG. 2*b*. In FIGS. 8*a* and 8*b*, the direction of the incident beam 33*a* is normal to the main reflector 40 of the antenna whereas in FIG. 8*c*, the direction of the incident beam 33*b* is squinted with respect to the normal direction. The phased array 41 consists of a plurality of elementary radiating elements 30, each elementary radiating element 30 being intended to emit and/or to receive beams of RF signals. Each elementary radiating element 30 is connected to an input/output port 27 of the BFN slice by an RF signals emission pathway and an RF signals reception pathway and by way of linking guides 42. Each emission pathway and each reception pathway can comprise an amplifier 31 intended to mask the energy losses in the BFN slices of the beamformer. On emission, the amplifier 31 is a power amplifier and on reception the amplifier 31 is a low noise amplifier. Optionally, each emission and reception pathway can also comprise a dynamic phase shifter 32, as represented for example in FIG. 8*d*, making it possible notably to compensate for the deformations of the main reflector 40 of the imaging array antenna and the static errors of fabrication and of integration of the antenna. The deformations of the main reflector may for example be due to temperature variations or to instabilities of a satellite to which the imaging array antenna is fixed. The input/output ports 25 linked to the second internal sources 18 of the BFN slice are intended to be linked on reception, to means for processing the signals received and on emission, to excitation means.

In reception, an incident signal beam 33*a*, 33*b* is reflected by the main reflector 40 on the phased array 41. The phased array 41 being defocused, the energy of the reflected beam 34*a*, 34*b* is picked up by almost the entirety of the radiating elements 30 of the phased array 41 and then transmitted by each reception pathway, to the input/output ports 27, and guided by the linking guides 42 up to the whole set of first internal sources 15 of the BFN slices. The first internal sources 15 re-emit the energy of the signal received in the BFN slice, where the energy is focused on one of the second sources 18 by way of the internal reflector 16 and transmitted to one of the input/output ports 25. The input/output port 25 which collects the focused energy depends on the direction of arrival of the signal. As shown by FIGS. 8*b* and 8*c*, for two different directions of arrival, the energy is focused on two different ports 25*a*, 25*b*.

On emission, an excitation signal is applied to one of the input/output ports 25 and transmitted, by way of the second source 18 to which it is connected, inside the BFN slice. In the BFN slice, the energy of the signal is reflected on the internal reflector 16 and then distributed over all the first sources 15 of the BFN slice. The signal beams synthesized by the BFN slice are then transmitted to all the defocused phased array 41 radiating elements 30 to which the first sources 15 are connected and then emitted toward the main reflector 40 of the antenna which reflects the beams toward zones of ground coverage constituting the spots.

The second embodiment of a BFN slice corresponding to FIGS. 2*b*, 8*b* and 8*c* makes it possible to obtain a more efficacious imaging array antenna than by using a multi-beam former according to the first embodiment corresponding to FIGS. 2*a* and 8*a*, in which the BFN slices comprise an internal reflector placed in an offset configuration. Indeed, in the second embodiment of a BFN slice, the second internal sources 18 associated with the input/output ports 25 are centered with respect to the internal reflector 16, thereby improving the squint performance of the imaging array antenna since the antenna will comprise fewer phase aberrations. Now, this optical configuration is possible only by virtue of the separation, over various substrate layers, of the signals incident and reflected on the internal reflector 16. With any other type of known multi-beam former, it would be impossible to produce an antenna with equivalent configuration operating in a free space since the phased array would then effect blocking to the signal reflected by the auxiliary reflector.

Moreover, by virtue of the presence of the reflector internal to the multi-beam former, and of the possibility of adding a dielectric in the BFN slice, thereby making it possible to decrease the bulk of the multi-beam former, the invention exhibits the advantage of being able to achieve, in the imaging array antenna associated with the multi-beam former, significant optical paths similar to those which are established in an antenna configuration with two reflectors of Cassegrain type while minimizing the antenna bulk. In this case, the reflector internal to the multi-beam former is of elliptical shape.

Another advantage of the imaging array antenna associated with the multi-beam former according to the invention, with respect to the configuration of an equivalent antenna of Cassegrain type, relates to its radiation performance. The imaging array antenna embodied on the basis of a reflector and of a defocused phased array and associated with the multi-beam former according to the invention employs several parameters making it possible to optimize its operation, such as the shape of the main reflector 40, the disposition of the radiating elements 30 of the phased array 41, the length of the linking guides 42, the disposition of the first internal sources 15, the shape of the internal reflector 16, and the disposition of the second internal sources 15. These various degrees of freedom can be optimized to minimize the phase aberrations in several directions of arrival, and thus considerably extend the angular coverage of the antenna. It is thus possible to cancel these aberrations in five different directions of arrival, thereby corresponding to an antenna with five foci. On the contrary, the antenna configuration of Cassegrain type can be optimized only as regards the shape of the main and auxiliary reflectors and thus form only two foci.

Finally a last advantage resides in the quality of overlap of the beams. A reflector antenna which comprises two contiguous sources disposed in the focal plane of the antenna generates two beams which overlap at a low level, typically −4 to −5 dB. The same problems of overlap between beams appear for an imaging array antenna with a quasi-optical multi-beam former according to the invention, but as described in conjunction with FIGS. 5*a*, 6 and 7, the invention makes it possible to solve this problem by adding extra BFN slices in the two stages of the quasi-optical multi-beam former whereas in the known antennas, this problem may be solved only by multiplying up the number of antennas used.

The two-dimensional multi-beam former may also be used in other types of antenna, such as for example a direct-radiation phased array or an imaging array antenna comprising two external parabolic reflectors of different sizes having the same focal length, such as represented for example in FIG. 9. In the case of a direct-radiation array, the antenna does not comprise any external reflector; the beams synthesized by the multi-beam former are emitted directly by the radiating elements of the phased array and form the ground spots. In the case of an imaging array antenna comprising two external reflectors consisting of a main reflector 40, and of an auxiliary reflector 44 of different sizes having the same focal length F, the phased array 41 associated with the two-dimensional multi-beam former according to the invention is placed in front of the auxiliary reflector 44. On reception, a signal beam incident on the main reflector 40 is reflected toward the auxiliary reflector 44 by passing through the focal plane F situated between the main reflector and the auxiliary reflector. The signal reflected a first time by the main reflector 40 and imaged by the focal plane F is reflected a second time by the auxiliary reflector 44 on the phased array 41 and focused by the multi-beam former. On emission, the beams synthesized by the multi-beam former are emitted by the phased array and then follow the propagation path inverse to that followed on reception.

In the various exemplary antenna embodiments described hereinabove, a single multi-beam former is connected to the phased array. Now, the multi-beam former can only operate in a single polarization whereas the phased array can extract signals in two orthogonal polarizations. Hence, to obtain a multi-beam antenna operating in two orthogonal polarizations, it is necessary to use two multi-beam formers and to connect the radiating elements of the phased array of the antenna to the two multi-beam formers.

Although the invention has been described in conjunction with particular embodiments, it is very obvious that it is in no way limited thereto and that it comprises all the technical equivalents of the means described as well as their combinations if the latter enter within the framework of the invention.

The invention claimed is:

1. A two-dimensional multi-beam former, comprising:

a first beamforming stage intended to synthesize beams focused along a first direction X in space and a second beamforming stage intended to focus the beams formed by the first stage along a second direction Y in space, the two beamforming stages being connected together, each stage comprises at least two multi-layer plane structures superposed one above the other, each multi-layer structure of the first and of the second stage comprises an internal reflector extending transversely to the plane of the multi-layer structure, at least two first internal sources disposed in front of the internal reflector and respectively linked to two first input/output ports aligned along a first axis of the multi-layer structure, at least two second internal sources disposed in a focal plane of the internal reflector and respectively linked to two second input/output ports aligned along a second axis of the multi-layer structure perpendicular to the first axis, the two second internal sources of the same multi-layer structure, respectively, of the first beamforming stage being respectively linked to two first internal sources of two different multi-layer structures of the second beamforming stage by way of the input/output ports, called linking ports, to which are respectively connected the second internal sources and the first internal sources, wherein:

the at least two first internal sources of each multi-layer structure are disposed in a first substrate layer inserted between an upper metallic plane and an intermediate metallic plane, the second sources are disposed in a second substrate layer inserted between the intermediate metallic plane and a lower metallic plane, the first and second substrate layers are coupled by the internal reflector extending from the lower metallic plane to the upper metallic plane and by way of an aperture or of coupling slots extending along the internal reflector and made in the intermediate metallic plane separating the first and second substrate layers, each multi-layer structure furthermore comprises first waveguides disposed in the second substrate layer, each first waveguide comprising a first guide part extending along a longitudinal axis of the multi-layer structure and connected to the second internal sources and a second bent guide part extending perpendicularly to the longitudinal axis and linked to a second input/output port.

2. The multi-beam former as claimed in claim 1, wherein: the first beamforming stage comprises Ny plane multi-layer structures superposed one above the other, each multi-layer structure of the first stage comprising Nx first internal sources disposed in front of the internal reflector of a corresponding multi-layer structure and connected to Nx input/output ports aligned parallel to an axis V and Mx second sources disposed in the focal plane of a corresponding internal reflector and connected to Mx linking ports aligned parallel to an axis U perpendicular to the axis V, the second beamforming stage comprises Mx plane multi-layer structures superposed one above the other, each multi-layer structure of the second beamforming stage comprising Ny first internal sources disposed in front of the internal reflector of the corresponding multi-layer structure and connected to Ny linking ports aligned parallel to an axis V' and My second sources disposed in the focal plane of the corresponding internal reflector and connected to My input/output ports ligned parallel to an axis U' perpendicular to the axis V', the Ny multi-layer structures of the first stage comprise Ny*Mx linking ports connected respectively to Mx*Ny corresponding linking ports of the Mx multi-layer structures of the second stage, Nx, Ny, Mx, My being integer numbers greater than 1, the linking ports of one and the same multi-layer structure of the first beamforming stage being respectively connected to different multi-layer structures of the second beamforming stage.

3. The multi-beam former as claimed in claim 2, wherein each linking port of an Nkth multi-layer structure of the first beamforming stage is connected to the Nkth linking port of one of the corresponding multi-layer structures of the second beamforming stage, Nk being an integer number lying between 1 and Ny inclusive.

4. The multi-beam former as claimed in claim 2, wherein the second beamforming stage comprises Mx first multi-layer structures and at least Mx second multi-layer structures and in that each linking port of an Nkth multi-layer structure of the first beamforming stage is connected to an Nkth linking port of one of the corresponding first multi-layer structures of the second beamforming stage and to the Nkth linking port of one of the corresponding second multi-layer structures of the second beamforming stage, Nk being an integer number lying between 1 and Ny inclusive.

5. The multi-beam former as claimed in claim 4, wherein the Mx second multi-layer structures of the second beamforming stage comprise first internal sources linearly shifted with respect to the first internal sources of the Mx first multi-layer structures of the second beamforming stage, the linear shift corresponding to a translation of all the first internal sources by one and the same distance T of less than a distance between centers of two first consecutive internal sources.

6. The multi-beam former as claimed in claim 4, wherein the Mx second multi-layer structures of the second beamforming stage comprise an internal reflector having an orientation shifted with respect to the internal reflector of the Mx first multi-layer structures of the second beamforming stage.

7. The multi-beam former as claimed in claim 1, wherein the first beamforming stage comprises Ny first and Ny second multi-layer structures and in that the at least two first internal sources of the Ny second multi-layer structures are linked to the at least two first internal sources of the Ny first multi-layer structures, the Ny second multi-layer structures of the first beamforming stage comprising first internal sources linearly shifted with respect to the first internal sources of the Ny first multi-layer structures of the first beamforming stage.

8. The multi-beam former as claimed in claim 1, wherein the first beamforming stage comprises Ny first and Ny second multi-layer structures and in that the at least two first internal sources of the Ny second multi-layer structures of the first stage are linked to the at least two first internal sources of the Ny first multi-layer structures of the first stage, the Ny second multi-layer structures of the first beamforming stage comprising an internal reflector having an orientation shifted with respect to the internal reflector of the Ny first multi-layer structures of the first beamforming stage.

9. The multi-beam former as claimed in claim 1, wherein the first and second substrate layers of each multi-layer structure comprise a dielectric material.

10. The multi-beam former as claimed in claim 9, wherein the dielectric material is a dielectric lens placed between the internal reflector and the at least two first internal sources and the at least two second internal sources, the dielectric lens having a convex periphery surface and comprising inclusions of air holes, the inclusions of air holes having a density increasing progressively from the internal reflector to the at least two first internal sources and the at least two second internal sources.

11. The multi-beam former as claimed in claim 1, wherein the first and second substrate layers of each multi-layer structure furthermore comprise a first dielectric material having a first dielectric permittivity, the first dielectric material comprising inclusions of a second dielectric material having a second dielectric permittivity lower than the first dielectric permittivity, the inclusions having a density increasing from the internal reflector to the at least two first internal sources and the at least two second internal sources.

12. The multi-beam former as claimed in claim 1, wherein the first substrate layer and the second substrate layer of each multi-layer structure comprise deformation means for deforming the internal reflector.

13. A multi-beam antenna, further comprising at least one two-dimensional multi-beam former as claimed in claim 1 and a phased array consisting of a plurality of elementary radiating elements, each elementary radiating element being linked to a corresponding input/output port of the first beamforming stage by way of a pathway for emitting and of a pathway for receiving RF signals.

14. The multi-beam antenna as claimed in claim 13, further comprising at least one main reflector, the phased array connected to the two-dimensional multi-beam former being placed in front of the main reflector in a defocused plane.

15. The multi-beam antenna as claimed in claim 13, further comprising at least one main reflector and an auxiliary reflector, the main reflector and the auxiliary reflector having different sizes and having the same focal length F and in that the phased array connected to the two-dimensional multi-beam former is placed in front of the auxiliary reflector.

16. The multi-beam antenna as claimed in claim 14, wherein each pathway for emitting and for receiving RF signals comprises a dynamic phase shifter.

17. A satellite telecommunication system, further comprising at least one antenna as claimed in claim 13.

* * * * *